US010457516B2

(12) United States Patent
Ohashi et al.

(10) Patent No.: US 10,457,516 B2
(45) Date of Patent: Oct. 29, 2019

(54) SHEET STORAGE APPARATUS AND PRINTING APPARATUS

(71) Applicant: CANON KABUSHIKI KAISHA, Tokyo (JP)

(72) Inventors: Takakazu Ohashi, Kawasaki (JP); Daiki Anayama, Yokohama (JP); Hiromasa Yoneyama, Chigasaki (JP); Yasuyuki Asai, Tokyo (JP); Takuya Suto, Kawasaki (JP); Tetsuo Kikuchi, Ayase (JP); Itaru Wada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/891,748

(22) Filed: Feb. 8, 2018

(65) Prior Publication Data

US 2018/0244484 A1 Aug. 30, 2018

(30) Foreign Application Priority Data

Feb. 27, 2017 (JP) ..... 2017-035277
May 12, 2017 (JP) ..... 2017-095541

(51) Int. Cl.

| | |
|---|---|
| ***B65H 31/26*** | (2006.01) |
| ***B41J 13/10*** | (2006.01) |
| ***B41J 11/00*** | (2006.01) |
| ***B65H 31/36*** | (2006.01) |
| ***B41J 15/04*** | (2006.01) |
| ***B65H 31/02*** | (2006.01) |
| ***B65H 31/20*** | (2006.01) |

(52) U.S. Cl.

CPC ..... *B65H 31/26* (2013.01); *B41J 11/0005* (2013.01); *B41J 13/106* (2013.01); *B41J 15/04* (2013.01); *B65H 31/02* (2013.01); *B65H 31/20* (2013.01); *B65H 31/36* (2013.01); *B65H 2405/112* (2013.01); *B65H 2405/312* (2013.01);

(Continued)

(58) Field of Classification Search

CPC ..... B65H 31/02; B65H 31/26; B65H 31/36; B65H 2405/1132; B41J 13/106

USPC ..... 271/223, 224

See application file for complete search history.

(56) References Cited

U.S. PATENT DOCUMENTS 2,904,335 A * 9/1959 Rabinow ..... B65H 31/36 271/219
4,197,045 A * 4/1980 Stauber ..... B65H 31/26 414/788.2

(Continued)

FOREIGN PATENT DOCUMENTS

JP 2015-189522 A 11/2015

OTHER PUBLICATIONS

U.S. Appl. No. 15/896,504, Hiromasa Yoneyama, Daiki Anayama, Yasuyuki Asai, Tetsuo Kikuchi, filed Feb. 14, 2018.

*Primary Examiner* — Michael C McCullough
(74) *Attorney, Agent, or Firm* — Venable LLP

(57) ABSTRACT

A sheet storage apparatus according to an embodiment of the present invention includes a receiving unit which receives a sheet that is discharged from a discharge port at a position below the discharge port, and a sheet butting unit which is provided in the vicinity of the receiving unit and receives a front end portion of the sheet. The sheet butting unit has a projection which is provided on at least one of an inner side surface and an inner upper surface of the sheet butting unit. The projection is configured to be capable of retaining a state (Continued)

of regulating vertically upward movement of the front end portion of the sheet being discharged from the discharge port.

6 Claims, 24 Drawing Sheets

(52) U.S. Cl.
CPC *B65H 2701/11312* (2013.01); *B65H 2801/36* (2013.01)

(56) References Cited

U.S. PATENT DOCUMENTS 6,494,450 B2 * 12/2002 Tsurumaki ..... B65H 31/02 271/220
7,588,249 B2 * 9/2009 Caron ..... B65H 1/06 271/221
7,837,190 B2 * 11/2010 Feygelman ..... B65H 31/02 271/220
8,752,827 B2 * 6/2014 Lee ..... B65H 31/36 271/224
8,757,615 B2 * 6/2014 Komatsu ..... B65H 83/025 271/207
9,272,872 B2 3/2016 Sugiyama et al.
9,890,001 B2 2/2018 Taniguchi et al.
2001/0010193 A1 * 8/2001 Tsurumaki ..... B65H 31/02 101/232
2013/0034376 A1 * 2/2013 Saiga ..... B41J 11/70 399/405

* cited by examiner

SHEET STORAGE APPARATUS AND PRINTING APPARATUS

BACKGROUND OF THE INVENTION

Field of the Invention

The present invention relates to a sheet storage apparatus that stores sheets such as discharged printed media, and to a printing apparatus including the sheet storage apparatus.

Description of the Related Art

Japanese Patent Laid-Open No. 2015-189522 discloses a large-format inkjet printing apparatus which performs printing on sheets reeled out of a roll. This inkjet printing apparatus is provided with reception members for receiving and storing printed sheets.

In this inkjet printing apparatus, a front end of a sheet comes into contact with a concave portion formed in each reception member. Thus, the inkjet printing apparatus discharges the sheet while regulating the front end of the sheet. However, if the sheet used therein has a strong curl, the front end of the sheet may curl up inside the concave portion and come off the concave portion. As a consequence, the inkjet printing apparatus may fail to discharge the sheet as intended.

The present invention has been made in view of the above-mentioned problem. An object of the present invention is to provide a sheet storage apparatus which is capable of reliably storing a strongly curling sheet, and to provide a printing apparatus including the sheet storage apparatus.

SUMMARY OF THE INVENTION

To solve the problem, a sheet storage apparatus according to an embodiment of the present invention comprises: a receiving unit configured to receive a sheet being discharged from a discharge port at a position below the discharge port; and a sheet butting unit provided in the vicinity of the receiving unit and configured to receive a front end portion of the sheet; wherein the sheet butting unit has a projection provided on at least one of an inner side surface and an inner upper surface of the sheet butting unit, and the projection is configured to be capable of retaining a state of regulating vertically upward movement of the front end portion of the sheet being discharged from the discharge port.

Further features of the present invention will become apparent from the following description of exemplary embodiments with reference to the attached drawings.

DESCRIPTION OF THE EMBODIMENTS

Figure 1A:
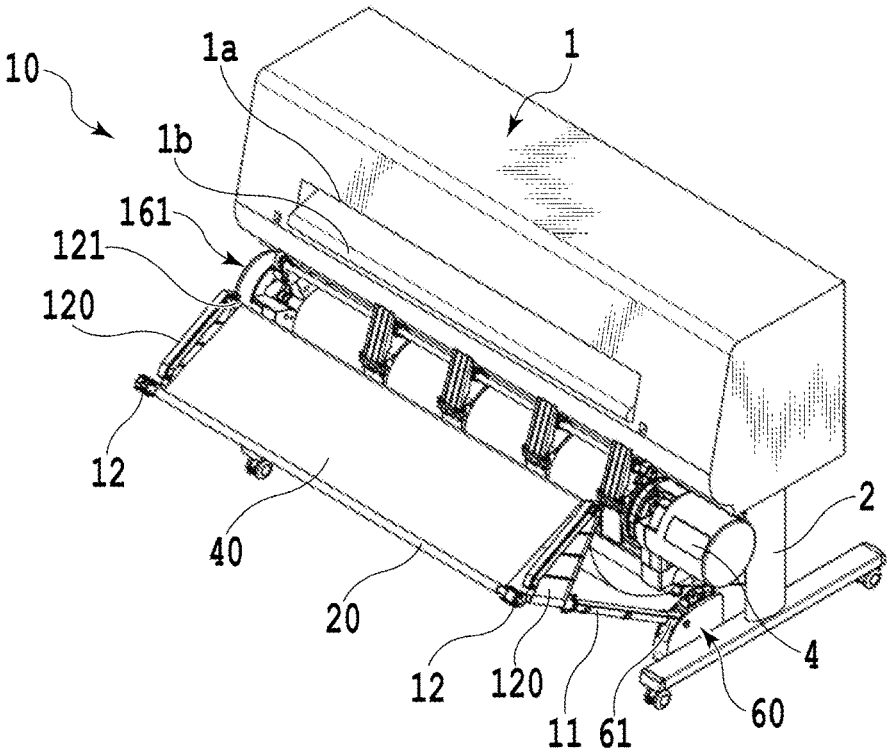
FIG. 1A is a perspective view and FIG. 1B is a side view of a printing apparatus according to an embodiment of the present invention.
Figure 1B:
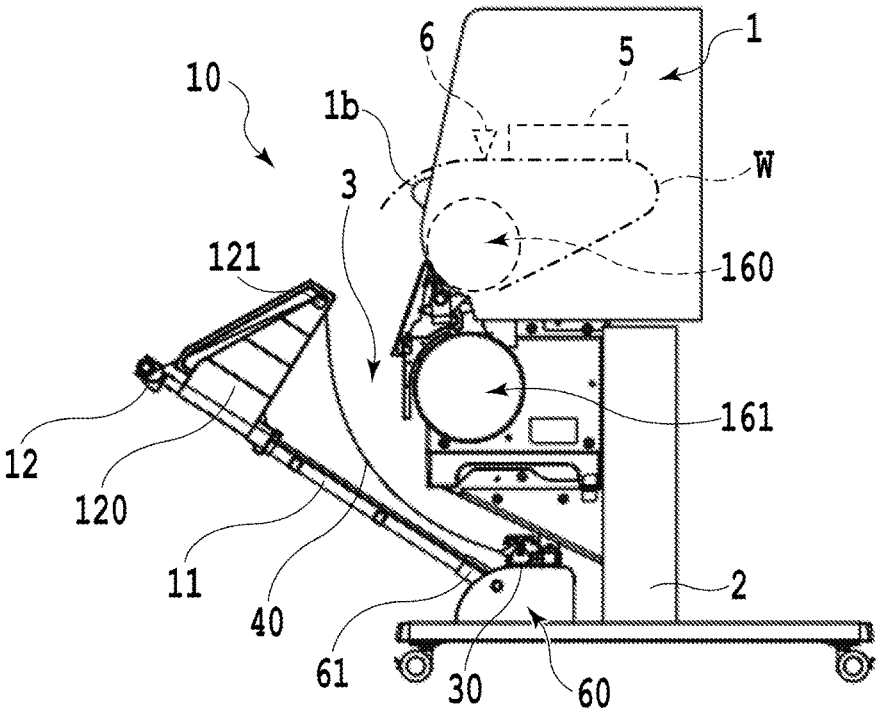
Figure 2A:
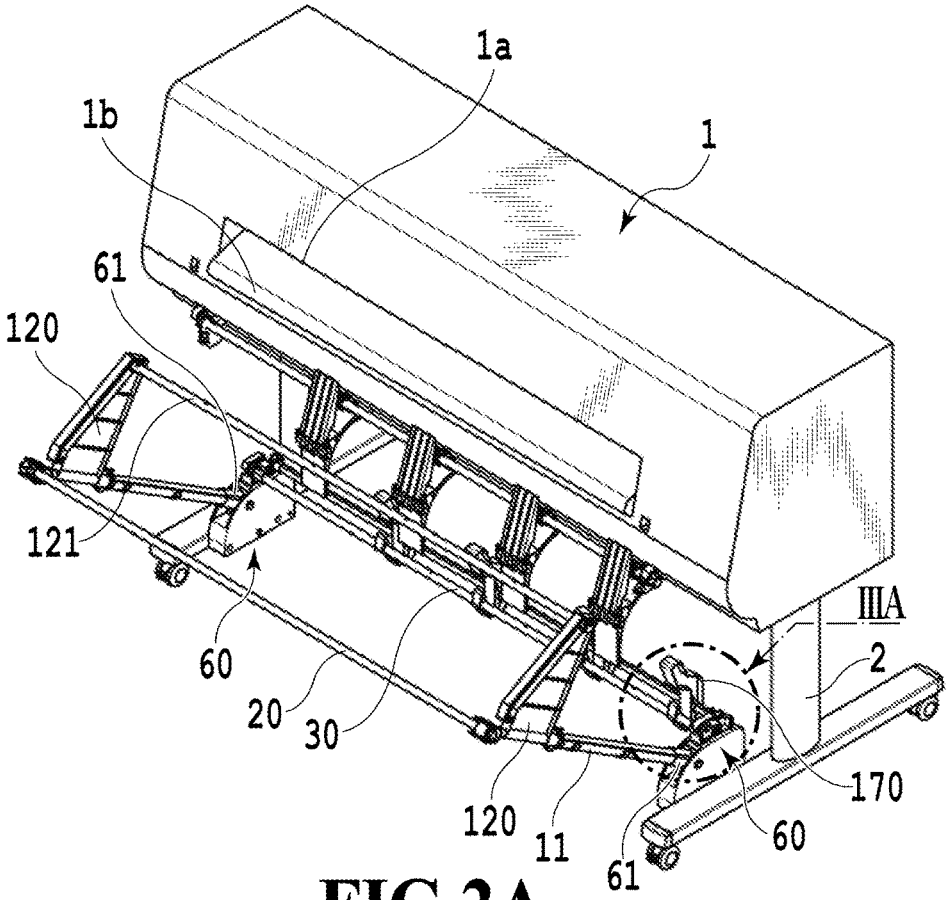
FIG. 2A is a perspective view and FIG. 2B is a front view of the printing apparatus of FIGS. 1A and 1B which is deprived of a receiver.
Figure 2B:
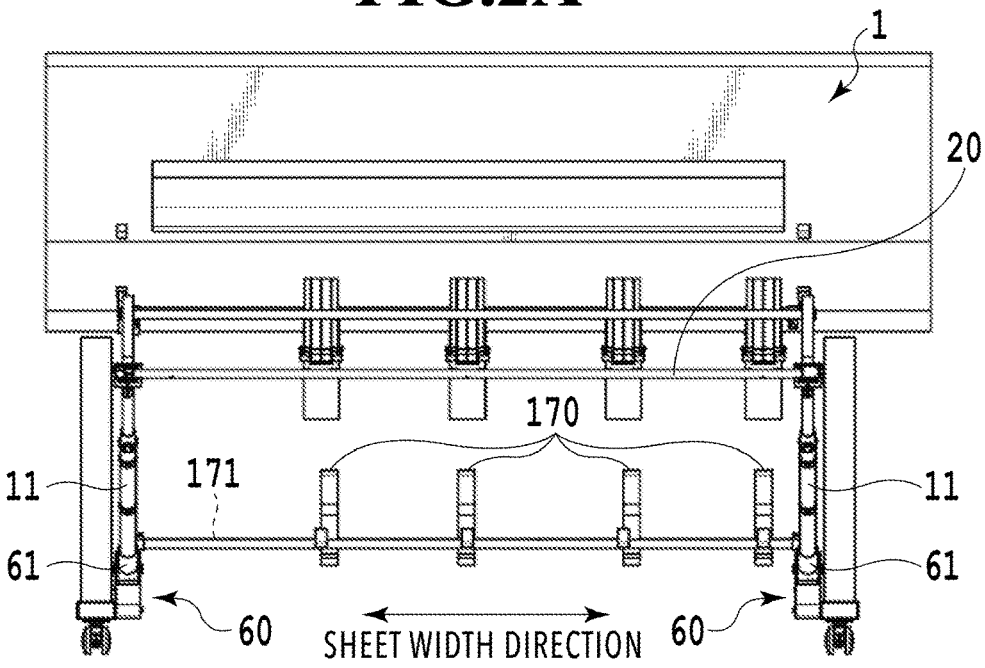

Hereinafter, embodiments of the present invention will be described in detail with reference to the accompanying drawings. FIG. 1A is a perspective view and FIG. 1B is a side view of a printing apparatus 10 according to an embodiment of the present invention. FIG. 2A is a perspective view and FIG. 2B is a front view of the printing apparatus 10 which is deprived of a receiver 40. First, a schematic configuration of the printing apparatus 10 according to the embodiment of the present invention will be described with reference to FIGS. 1A to 2B.

The printing apparatus 10 includes a body 1, legs 2 that support the body 1, and a sheet basket 3 (a sheet storage apparatus) fitted on the legs 2. The body 1 includes roll holders 160 and 161, each of which rotatably holds a roll (a rolled sheet) formed by winding an elongated sheet (a continuous sheet) around a paper tube. The rolls held by the roll holders 160 and 161 are reeled out and fed as sheets to a printing unit 5 through a feeding mechanism (not shown) and the like. The roll holder 161 (a second holder) is located below the roll holder 160 (a first holder). In other words, the roll holders 160 and 161 are arranged in a vertical direction. Here, the roll holder 161 located below may be provided with a function that enables the roll holder 161 to reel in the sheet which is supplied from the roll holder 160 and printed.

Moreover, the body 1 includes the printing unit 5 configured to perform printing on a conveyed sheet W, which is a printing medium reeled out of the roll housed in each of the roll holders 160 and 161 and is conveyed by a conveyance mechanism. Here, a cutter 6 is provided on the route from a point of printing by the printing unit 5 to a point of discharge from a discharge port 1*a*. The printed sheet is cut out by the cutter 6 at a predetermined position. Furthermore, the body 1 includes the discharge port 1*a* that discharges the printed sheet W, and a discharge port guide 1*b* that guides the discharged sheet to the sheet basket 3. The sheet being discharged by inches along with a printing operation passes through the discharge port guide 1*b*, then changes its traveling direction downward owing to its own weight, and starts drooping down. Here, the roll holders 160 and 161 are located below the discharge port 1*a* and the discharge port guide 1*b*. In this way, the two roll holders 160 and 161 are provided substantially at a central position in a height direction of the printing apparatus 10.

Figure 7:
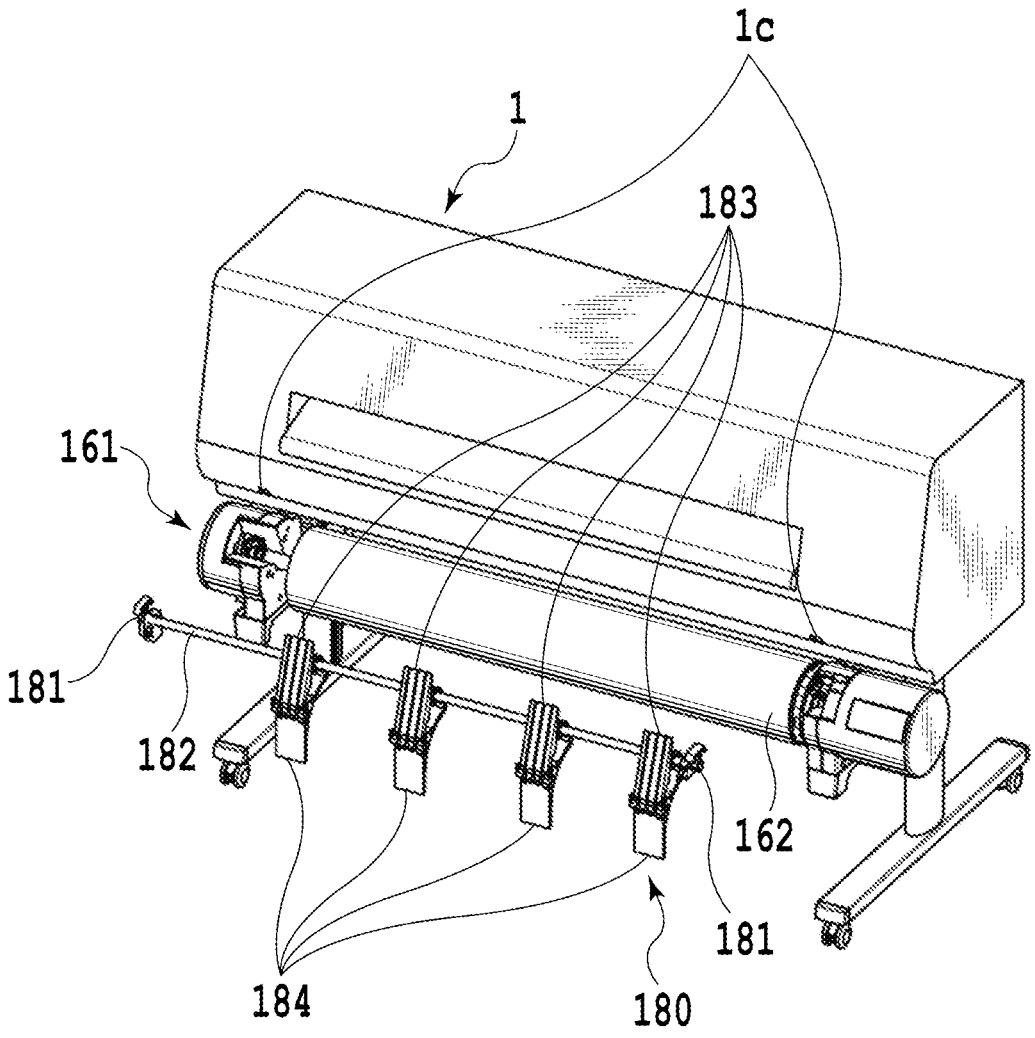
FIG. 7 is a perspective view for explaining a guide flapper unit.

The roll holders 160 and 161 are provided on a front side of the printing apparatus 10 where the discharge port 1*a* is open. This makes it possible to set a roll on the roll holder 160 provided inside from the front side of the printing apparatus by opening a housing of the body 1 after moving the sheet basket 3, for example. Also, it is possible to set a roll on the roll holder 161 from the front side of the printing apparatus. Thus, the user can conduct replacement of the rolls from the front side without having to move the printing apparatus, and a load on the user associated with this operation is reduced accordingly. Though details of a method of moving the sheet basket 3 will be described later, a guide flapper unit 180 can be easily removed as shown in FIG. 7, thereby enabling the user to set the rolls on the roll holders 160 and 161.

Moreover, the body 1 includes an operating unit 4. The user can input various commands such as sheet size specification and switching between online and offline statuses by operating various switches provided on the operating unit 4. Although this embodiment is described on the assumption of a two-stage roll configuration provided with the two roll holders, the present invention is not limited only to this configuration but is also applicable to a printing apparatus including three or more roll holders. Here, if such a printing apparatus includes three or more roll holders, then the printing apparatus is at least provided with the two roll holders 160 and 161.

The sheet basket 3 is configured to store the sheets that are cut out by the cutter 6 after the printing. The sheet basket 3 includes a sheet-shaped receiver 40 made of a thin, flat, and flexible material such as a cloth and a plastic. One end portion of this receiver 40 is held on a top rod 20 by using receiver holders 100 (see FIG. 4) to be described later, while another end portion thereof is held on a rear rod 30. In other words, the top rod 20 and the rear rod 30 function as holders to hold the two end portions of the receiver 40. Specifically, the top rod 20 holds the end portion of the receiver 40 on a downstream side (which is away from the body 1) in a sheet discharge direction viewed from the discharge port 1*a*, while the rear rod 30 holds the end portion of the receiver 40 on an upstream side (which is close to the body 1) in the sheet discharge direction. Two ends of the top rod 20 are connected to two side rods 11, respectively, by using connectors 12. The side rods 11 are held by side rod angle retainers 60 through side rod supports 61. Each side rod angle retainer 60 is fitted on the corresponding leg 2. An intermediate rod 121 is positioned by intermediate rod positioning members 120 fitted on the side rods 11, and supports the receiver 40. In other words, the intermediate rod 121 is movable and functions as a support member that supports an intermediate part of the receiver 40.

Figure 3A:
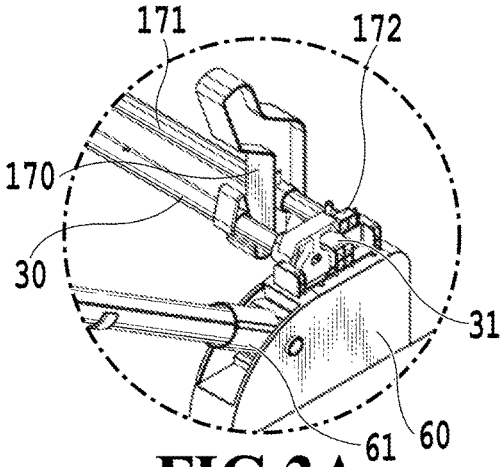
FIGS. 3A to 3E are views for explaining a first sheet butting portion of a sheet storage apparatus.

As shown in FIGS. 2A and 2B, the sheet basket 3 includes multiple sheet butting members 170. The multiple sheet butting members 170 are arranged in a sheet width direction (a direction intersecting (orthogonal to) the sheet discharge direction) on a support rod 171 provided in parallel to the rear rod 30. FIG. 3A is a perspective view for explaining a first sheet butting portion of the sheet basket 3, which is an enlarged view of a portion IIIA surrounded by a broken line in FIG. 2A. As shown in FIG. 3A, the sheet butting members 170 are provided on the support rod 171 placed in parallel to the rear rod 30 that is held by rear rod holding members 31. The support rod 171 is disposed on the side rod angle retainers 60 while being held by support rod holding members 172. The sheet butting members 170 collectively constitute a first sheet butting portion that receives each printed sheet guided to the receiver 40. Here, the above-described sheet butting members 170 are located more on a rear surface side (on the back side) of the printing apparatus than the roll holder 161 is, for example. Specifically, the sheet basket 3 is provided with a storage unit, which is capable of storing the sheets, in such a way as to encompass a region located below the roll holder 161 in terms of the direction of gravitational force. In this way, the printing apparatus 10 is formed compact in a depth direction (a front-back direction) since a space below the roll holder 161 can be used as part of the storage unit. Though details will be described later, modified examples of the first sheet butting portion as shown in FIGS. 3B to 3E are also conceivable.

Figure 4:
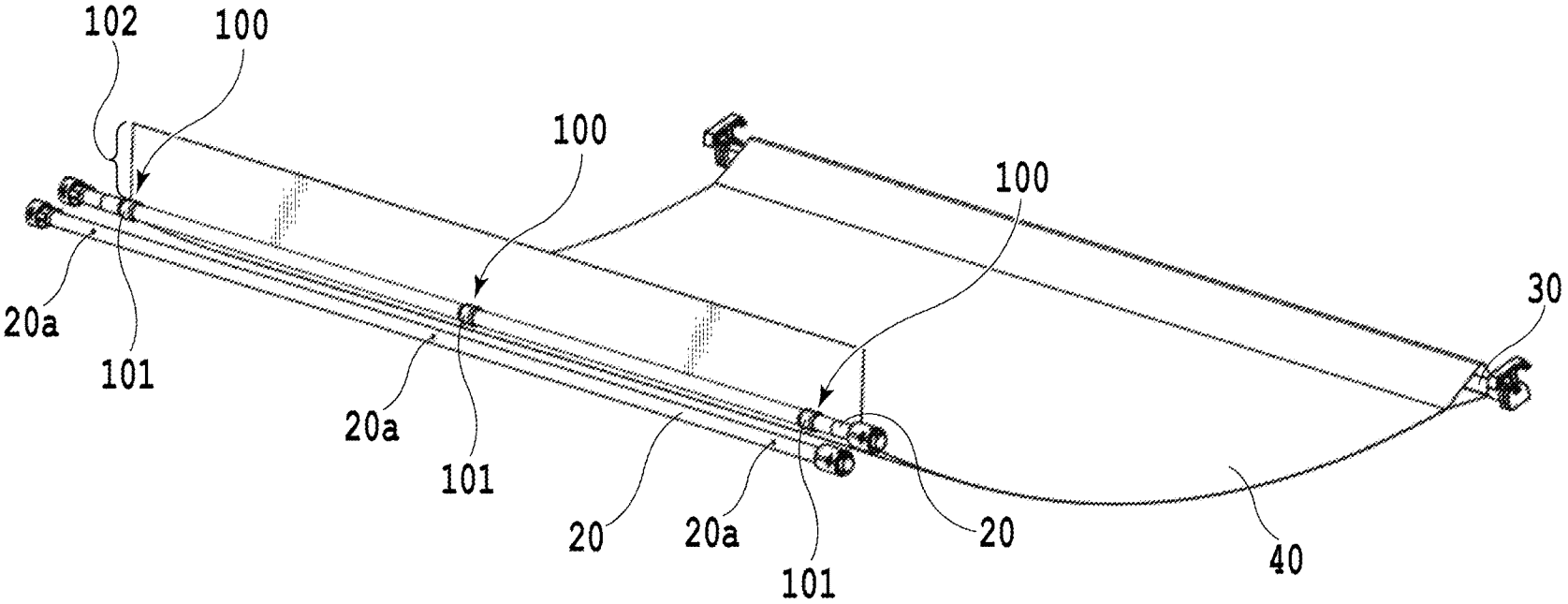
FIG. 4 is a perspective view for explaining receiver holders of the sheet storage apparatus.

FIG. 4 is a perspective view for explaining the receiver holders 100 of the sheet basket 3. Each receiver holder 100 is formed from a fixture member 101 that fixes the receiver 40 to the top rod 20. The top rod 20 has three holes 20*a*, and the receiver 40 also has not-illustrated holes at positions corresponding to the holes 20*a*. In the state where the receiver 40 surrounds the top rod 20, the fixture member 101 is fitted so as not to rotate the receiver 40 about the top rod 20 by inserting a not-illustrated pin into each hole 20*a* in the top rod 20 in such a way as to tuck the receiver 40. The receiver 40 is fixed in the state of being provided with a receiver marginal portion 102 that covers over the fitted fixture member 101. According to this configuration, it is possible to fix the receiver 40 to the top rod 20 and to avoid a scratch on a printed image caused by direct contact of a printed surface of the sheet with the fixture member 101 at the time of sheet discharge.

Figure 5:
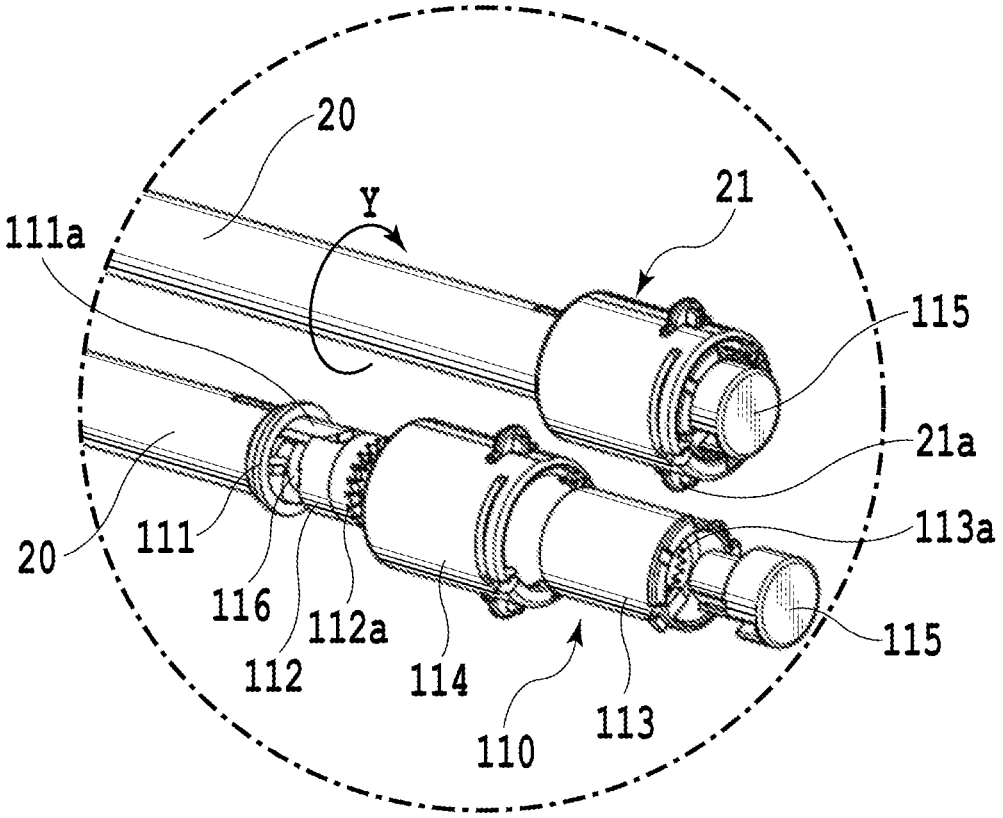
FIG. 5 is a perspective view for explaining a receiver reeler of the sheet storage apparatus.

FIG. 5 is a perspective view for explaining a receiver reeler 110 of the sheet basket 3, which is a partially enlarged view of an end portion of the top rod 20. The receiver reeler 110 changes a length of the receiver 40 by reeling in the receiver 40. The receiver reeler 110 includes a rod engagement member 111, a rotary clutch 112, a fixed clutch 113, a compression spring 116, a release button 115, and a housing 114. The rod engagement member 111 is unrotatably fitted on the top rod 20 while the rotary clutch 112 is rotatably engaged with convex portions 111*a* of the rod engagement member 111. At a position opposed to a serrated portion 112*a* of rotary clutch 112, the fixed clutch 113 includes a similar serrated portion 113*a* which is coaxially provided. The compression spring 116 biases the rotary clutch 112 toward the fixed clutch 113. The release button 115 enables the rotary clutch 112 to be pressed toward the rod engagement member 111 against the compression spring 116. The user can separate the rotary clutch 112 from the fixed clutch 113 by pressing the release button 115. The housing 114 encloses the rod engagement member 111 in a rotatable manner and encloses the fixed clutch 113 in an unrotatable manner. Moreover, the housing 114 is fixed to the side rods 11 while being subjected to restriction on rotation about a center axis of the top rod 20 by joint members 13 to be described later. As mentioned above, the rotary clutch 112 and the fixed clutch 113 collectively constitute a clutch mechanism applicable to the receiver reeler 110.

Figure 6:
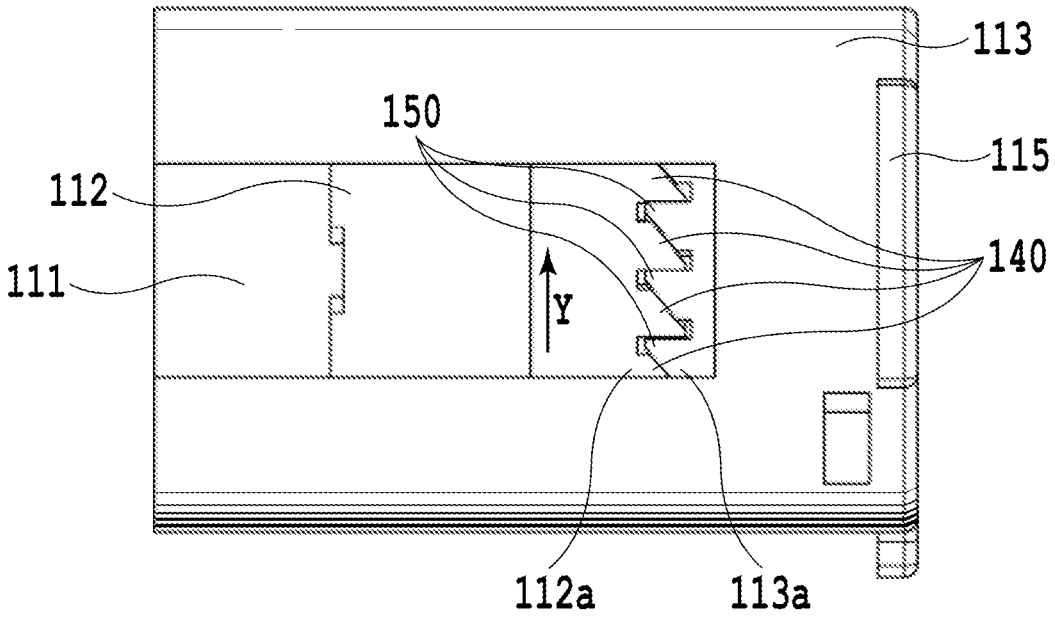
FIG. 6 is a diagram for explaining a clutch mechanism applicable to the receiver reeler.

FIG. 6 is a diagram for explaining the clutch mechanism applicable to the receiver reeler 110, which is a partial cross-sectional view of the receiver reeler 110. FIG. 6 illustrates a state in which the serrated portion 113*a* of the fixed clutch 113 mesh with the serrated portion 112*a* of the rotary clutch 112. When the top rod 20 is rotated in a Y direction in this state, the serrated portion 112*a* of the rotary clutch 112 climbs on tapered surfaces 140 of the serrated portion 113*a* of the fixed clutch 113 against the compression spring 116. In other words, the rotary clutch 112 moves in a direction away from the fixed clutch 113 in such a way as to disengage the serrated portions. As a consequence, it is possible to reel in the receiver 40 fitted on the top rod 20 by using the receiver holders 100. The top rod 20 cannot be rotated in the reverse direction to the Y direction because stopper surfaces 150 on the serrated portions 112*a* and 113*a* mesh with one another. In other words, the receiver 40 is locked in a reeled-in state.

As described above, even when a discharged sheet are placed on the receiver 40, the receiver 40 having been reeled in is kept from being reeled out again due to the weight of the sheet. Accordingly, the user can use the receiver 40 for storing the discharged sheet while adjusting the length of the receiver 40 to a desired length. Here, the reel lock on the receiver 40 can be released by moving the rotary clutch 112 in the direction away from the fixed clutch 113 by pressing the release button 115 that releases the receiver 40 wound around the top rod 20.

Here, the rotation in the direction of the arrow Y in FIG. 5 is defined as the reel-in direction. Instead, the clutches may be configured to be capable of reeling in the receiver in the reverse direction while blocking the rotation in the Y direction by changing the structures of the tapered surfaces 140 and the stopper surfaces 150 of the serrated portions thereof. Alternatively, a configuration to allow the reel-in in both directions is also applicable. Moreover, an operating load is also adjustable by changing a set value of the compression spring. Furthermore, the receiver reeler 110 may be provided on the rear rod 30 side instead of the top rod 20 side, or may be each provided on both of the rods.

The sheet basket 3 includes a guide flapper unit 180. Now, details of the guide flapper unit 180 will be described with reference to FIGS. 7 to 10B. Note that illustration of part of the configuration of the sheet basket 3 is omitted in order to facilitate the understanding of the configuration of the guide flapper unit 180. FIG. 7 is a perspective view for explaining the guide flapper unit 180. The guide flapper unit 180 includes multiple flappers 183, multiple guides 184 on which the flappers 183 are openably and closably fitted, respectively, and a guide rod 182 that holds the multiple guides 184. Each guide 184 includes a sliding plate 186 (see FIGS. 9A to 9C) to be described later, and functions as a guide unit that guides a front end of each sheet. Moreover, the guide 184 also functions as a support unit (a first support unit) that supports the corresponding flapper 183. Hook members 181 are provided at both ends of the guide rod 182 (a rod). The respective hook members 181 are configured to be fitted on hole portions 1*c* provided at two positions of the body 1. Hence, the guide flapper unit 180 is attachable to and detachable from the body 1.

Thus, an operation to replace the rolls set on the roll holders 160 and 161 is facilitated. While FIG. 7 illustrates four guides 184 each provided with the flapper 183, the number of the guides 184 is not limited only to the illustrated example. The guide flapper unit 180 may include one or more guides 184 depending on reception embodiments to be described later.

Figure 8A:
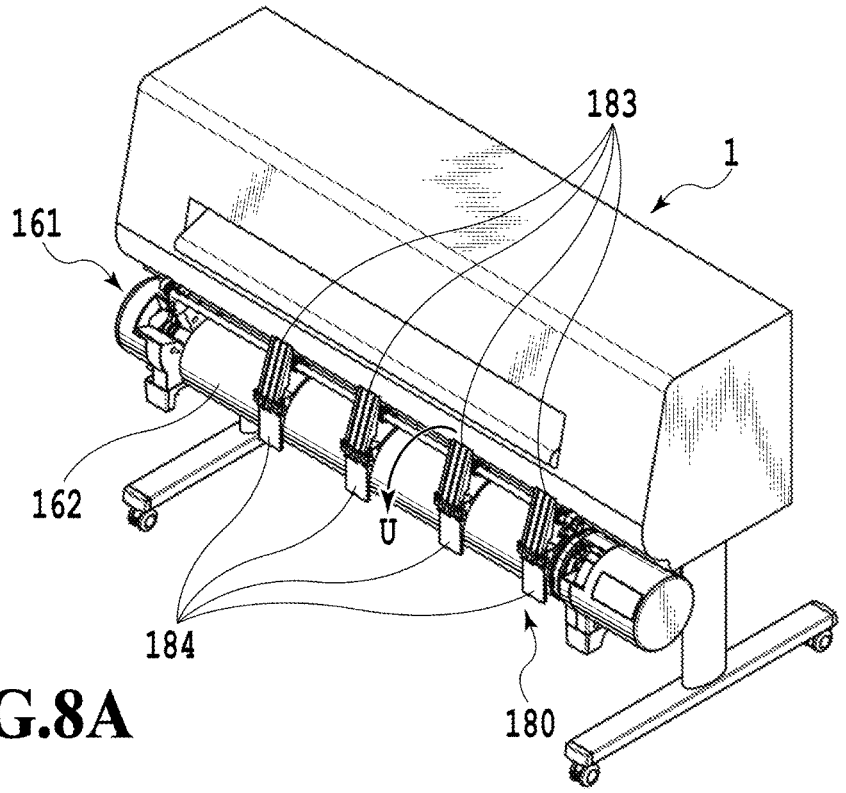
FIGS. 8A and 8B are perspective views of the guide flapper unit in a state where flappers therein are closed and in a state where some of the flappers are open, respectively.
Figure 8B:
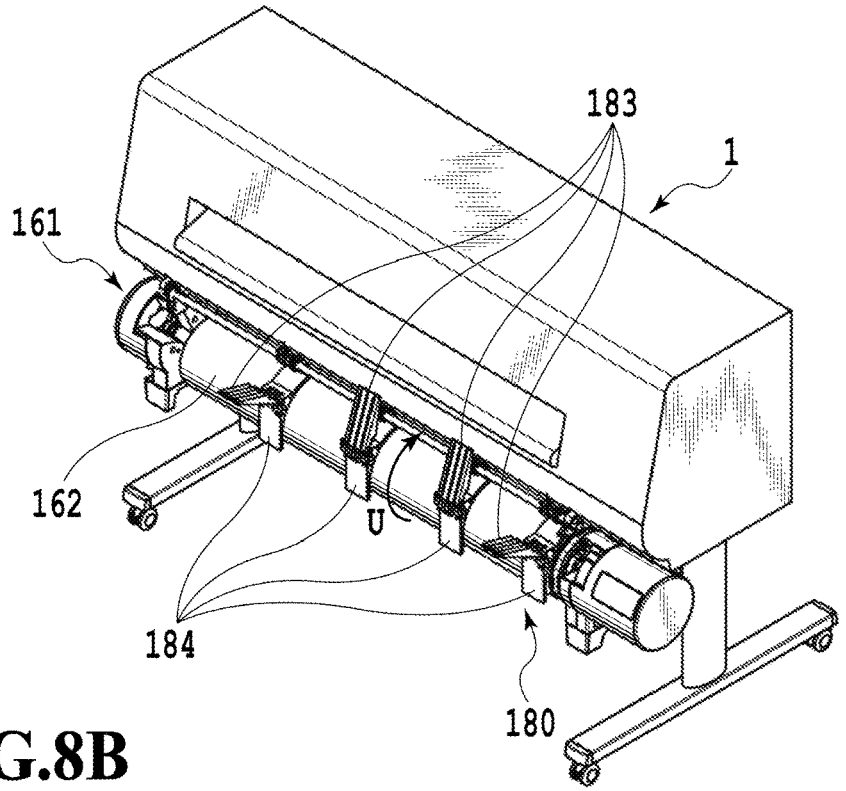

FIGS. 8A and 8B are perspective views of the guide flapper unit 180 in a state where the flappers 183 therein are closed and in a state where some of the flappers 183 are open, respectively. Note that a state where the flapper 183 is open represents a state (a first state) in which a laterally concave portion formed in the guide 184 to be described later is open and the flapper 183 is located at a position where the flapper 183 can support a front end portion (a region for a predetermined length from a front end) of a sheet discharged from the discharge port 1*a*. On the other hand, a state where the flapper 183 is closed represents a state (a second state) in which the concave portion is covered with the flapper 183 and the flapper 183 is located at a position where the flapper 183 cannot support the front end portion of the sheet discharged from the discharge port 1*a*.

The guides 184 on which the flappers 183 are fitted, respectively, are arranged in the sheet width direction. Each of the flappers 183 is independently and individually openable and closable in a direction of an arrow U. The flappers 183 and the guides 184 collectively function as a receiving unit that receives printed sheets. Details of the receiving unit will be described later. In this way, a handle member connected to the multiple reception members as disclosed in Japanese Patent Laid-Open No. 2015-189522 is no longer necessary. According to the printing apparatus 10, it is possible to operate the flappers 183 with a smaller force than that required in the printing apparatus of Japanese Patent Laid-Open No. 2015-189522.

Figure 9A:
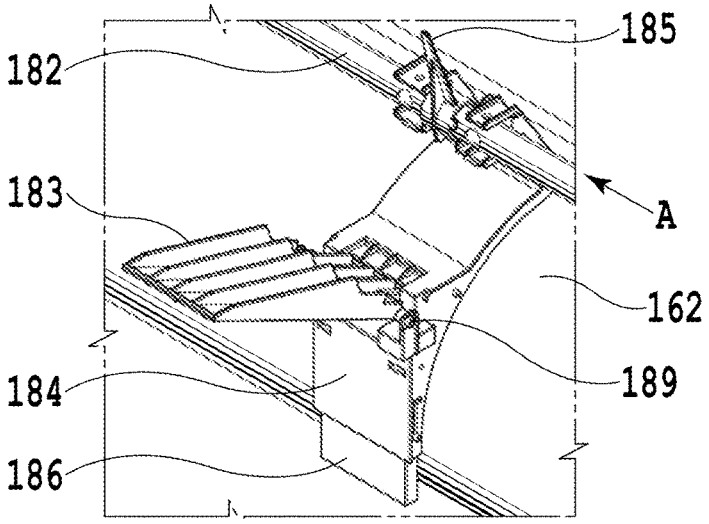
FIG. 9A is a perspective view for explaining the state where one of the flappers in the guide flapper unit is open.
Figure 9B:
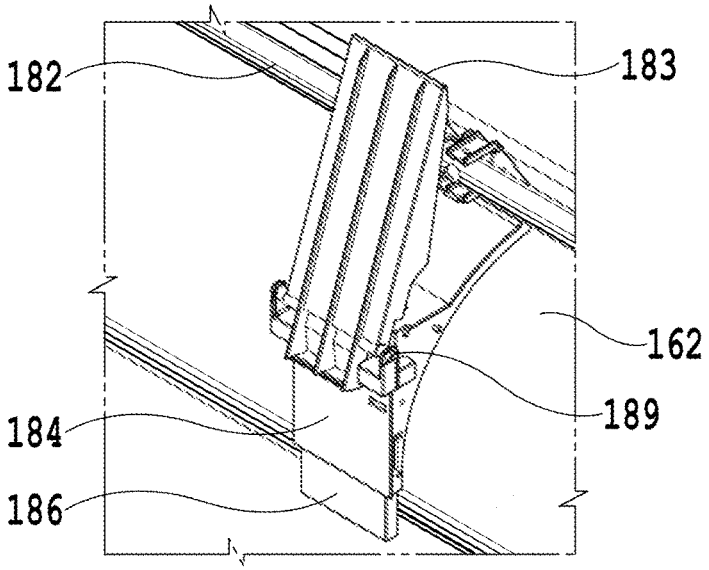
FIG. 9B is a perspective view for explaining the state where the flapper is closed.
Figure 9C:
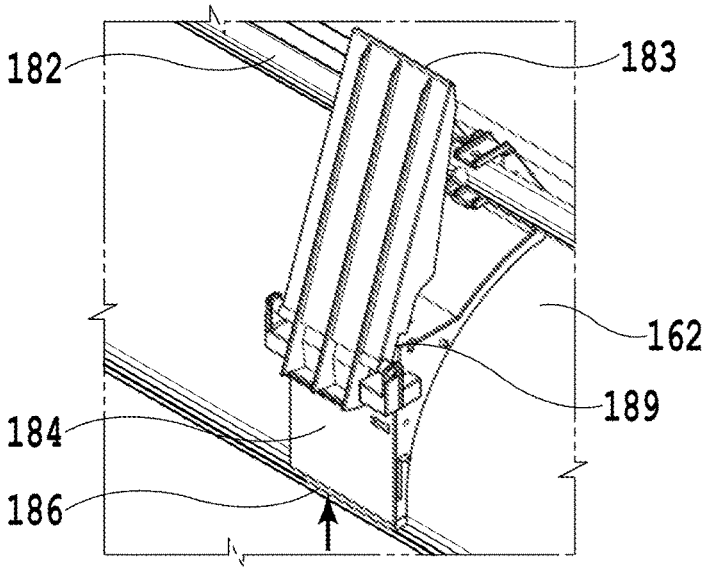
FIG. 9C is a perspective view showing a state where a sliding plate is moved up.

FIGS. 9A, 9B, and 9C are enlarged views showing one of the flappers 183 and the corresponding guide 184 of the guide flapper unit 180. Specifically, FIG. 9A is a perspective view for explaining the state where the flapper 183 in the guide flapper unit 180 is open, FIG. 9B is a perspective view for explaining the state where the flapper 183 is closed, and FIG. 9C is a perspective view showing a state where the sliding plate 186 is moved up.

The guide 184 is fitted onto the guide rod 182, and forms a shape of a guide which is concentric with an outer periphery of a roll 162 set on the roll holder 161. Since the handle member as disclosed in Japanese Patent Laid-Open No. 2015-189522 is not provided, the guide flapper unit 180 can be located between the roll holder 160 and the roll holder 161 and at a position closer to the roll holders 160 and 161. The above-described configuration makes it possible to achieve space saving. In addition, the guides 184 can be located on the back side of the body 1. Accordingly, even when discharging a strongly curling sheet, it is possible to guide the front end of the sheet, which is curling toward the body 1, smoothly to the sheet basket 3. In other words, according to this embodiment, it is possible to guide the front end of the sheet more reliably to the sheet basket 3.

In the state where the flapper 183 is open as shown in FIG. 9A, a front end of a sheet guide 185 is in contact with the body 1. In this way, the sheet guide 185 can fulfill a role in delivering the front end of the sheet from the body 1 side to the guide 184 side at the time of sheet discharge. On the other hand, in the state where the flapper 183 is closed as shown in FIG. 9B, a front end portion 183*a* of the flapper 183 is in contact with the body 1. In this state, therefore, the flapper 183 can fulfill a roll in guiding the front end of the sheet. Moreover, both surfaces of the flapper 183 are provided with projecting portions (ribs). The provision of the ribs reduces a contact area between the sheet and the flapper 183, and makes it possible to reduce friction resistance between the flapper 183 and the sheet, and moreover, to reduce the weight of the flapper 183. The reduction in weight of the flapper 183 makes it possible to reduce a force necessary for the user to open and close the flapper 183.

A rotational center 189 of the flapper 183 is located at a lower part of the flapper 183 in terms of the direction of gravitational force. Then, owing to the rotational center 189, the flapper 183 is designed such that the front end portion 183*a* of the flapper 183 comes close to (comes into contact with) the body 1 when the flapper 183 is closed and the front end portion 183*a* recedes from the body 1 when the flapper is open. The rotational center 189 is located below a rotational center of the roll on the roll holder 160 and above a rotational center of the roll on the roll holder 161 when the guide flapper unit 180 is disposed between the roll holders 160 and 161. Accordingly, in the printing apparatus 10, the discharge port 1*a*, the rotational center of the roll on the roll holder 160, the rotational center 189 of the flapper 183, and the rotational center of the roll on the roll holder 161 are arranged in this order in terms of the direction of gravitational force. In other words, the discharge port 1*a*, the rotational center of the roll on the roll holder 160, the rotational center 189 of the flapper 183, and the rotational center of the roll on the roll holder 161 are arranged such that heights thereof are reduced in this order. Moreover, the rotational center 189 of the flapper 183 is provided in such a position that the front end portion 183*a* of the flapper 183 comes closer to the body 1 than the rotational center 189 is when the flapper 183 is closed.

According to the configuration described above, it is possible to support the flapper 183 just by providing a butting surface, which serves for positioning when the flapper 183 is open, around a rotational axis in the structure to open and close the flapper 183, and thus to simplify the configuration. On the other hand, a rotational center of each reception member in the printing apparatus of Japanese Patent Laid-Open No. 2015-189522 is provided above the reception member in terms of the direction of gravitational force. Accordingly, this printing apparatus requires a complicated structure such as the lock mechanism when keeping the reception member substantially in a horizontal state. As described above, according to this embodiment, it is possible to obtain an advantage of simplification of the structure to open and close the flapper 183.

By simplifying the structure to open and close each flapper 183 as described above, the component to receive the discharged sheets is reduced in size and the guides 184 are arranged in a small space between the two roll holders 160 and 161. Moreover, the multiple flappers 183 are configured to be openable and closable individually and independently. In this way, it is possible to form the sheet basket 3 into the simpler structure than a medium reception unit of the printing apparatus of Japanese Patent Laid-Open No. 2015-189522. Moreover, the roll holders 160 and 161 are provided substantially at the central position in the height direction on the front side of the printing apparatus 10. As a consequence, it is relatively easier to conduct the operation to replace the rolls in the printing apparatus 10, which can also be installed more stably as a consequence of lowering the position of the center of gravity. Also, it is possible to store sheets in various sizes in a sorted manner by changing layout positions and the numbers of the guides 184 each provided with the flapper 183, the details of which will be described later.

Each guide 184 includes the sliding plate 186 (a sliding member), which is located at a lower end of the guide 184 and made vertically slidable inside the guide 184. The sliding plate 186 is independently operable as with the flapper 183. FIGS. 9A and 9B show a state where the sliding plate 186 is pulled down from the guide 184, while FIG. 9C shows a state where the sliding plate 186 is pulled up and put back into the guide 184. The sliding plate 186 is used for forming the receiving unit for the sheets, the details of which will be described later. Here, in order to render the flapper 183 selectively changeable in the sheet width direction, the guide 184 may be configured to be attachable to and detachable from the guide rod 182 at either a predetermined position or a desired position, or may be configured to be movable in the width direction.

Figure 10A:
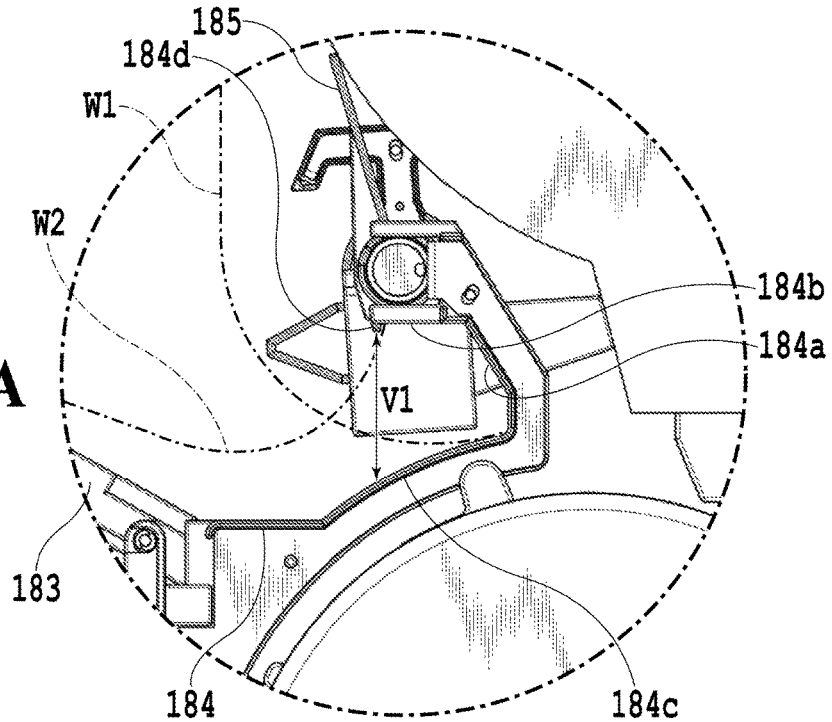
FIGS. 10A and 10B are partially enlarged side views for explaining the guide flapper unit.

FIG. 10A is a partially enlarged side view of the guide flapper unit 180, which illustrates the state where the flapper 183 is open. The guide 184 is provided with the laterally concave portion (a butting portion) that includes a first regulating surface 184*a*, a second regulating surface 184*b*, and a third regulating surface 184*c*. A convex portion 184*d* in a projecting shape (that is, a projection) is provided in the vicinity of an opening on an upper surface (the second regulating surface 184*b*) of the concave portion. The third regulating surface 184*c* being opposed to the second regulating surface 184*b* is formed to extend downward from one end on an upstream side in the sheet discharge direction to another end on the other side and to have the same curvature as that of the roll holder 161 concentrically. Moreover, the guide 184 has a clearance V1 defined between a front end of the convex portion 184*d* and a point on the third regulating surface 184*c* (that is, a lower surface of the concave portion) vertically below the convex portion 184*d*. The clearance V1 is defined to be greater than a sum of a thickness of the maximum number of loaded sheets, and a maximum value of a curling amount of the front end of the sheet, or more specifically, a distance from the lowermost surface of the sheet in the state of drooping vertically downward to the front end of the sheet that is warped vertically upward to the maximum.

In one example, the curling amount of the front end of the sheet is large, and the maximum number of loaded sheets is set to 100 sheets in the case of plain paper wound around a generally used paper tube having a 2-inch (50.8 mm) diameter. Each sheet of the plain paper has a thickness of 0.1 mm, and the thickness when loading 100 sheets thereof is equal to 10 mm (=100×0.1). The maximum value of the curling amount of the front end of the sheet (that is, the distance from the lowermost surface of the sheet in the state of drooping vertically downward to the front end of the sheet at a portion close to the paper tube at the beginning of winding the sheet, which is warped vertically upward) is equal to 10 mm. Accordingly, in this example, a length of the clearance V1 is set equal to or above 20 mm (=100×0.1+10 mm). The second regulating surface 184*b* is formed such that its length in the sheet discharge direction (that is, the discharge direction of the sheet or a depth direction of the concave portion) is smaller than the radius (25.4 mm) of the paper tube. A height in a perpendicular direction of the convex portion 184*d* (that is, an amount of protrusion from the upper surface of the concave portion) is formed greater than the maximum thickness of the sheet expected for use. In this example, this height is defined greater than the thickness 0.1 mm of the plain paper.

The usage embodiment of the flexible receiver 40 is modifiable by combining the aspects of the receiver reeler 110 and the guide flapper unit 180 described above. In other words, when the sheet basket 3 receives the discharged printed sheet, the user can select various reception embodiments. Thus, the receiver 40 meets the need for diversification in printing embodiments. Details of various reception embodiments will be described below.

First Reception Embodiment

Figure 11A:
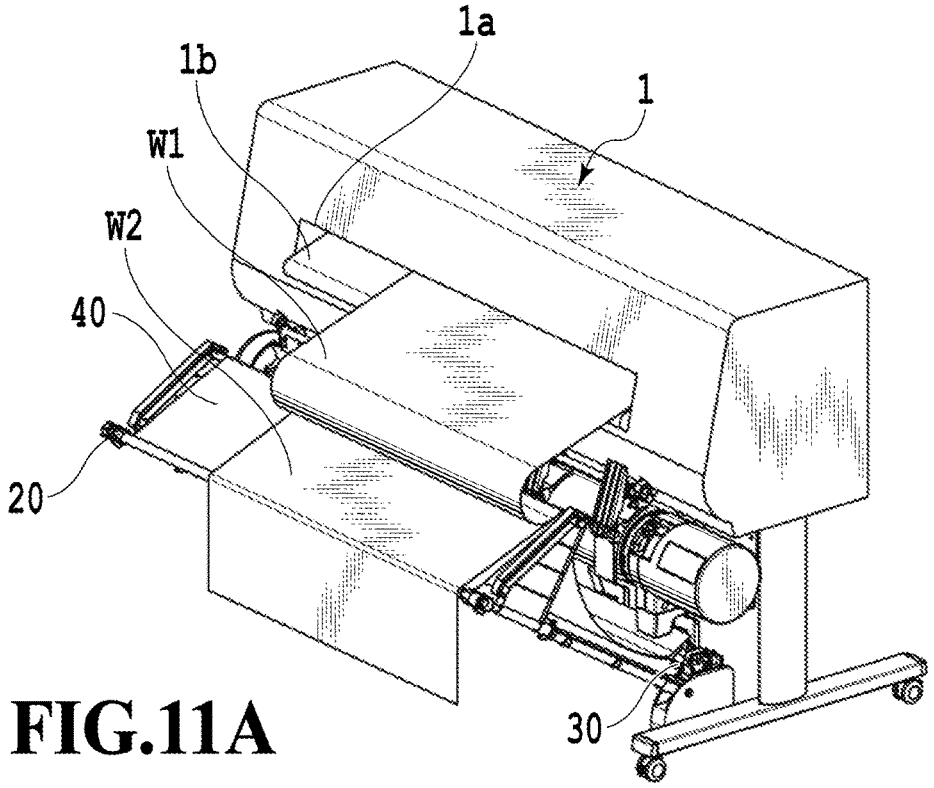
FIG. 11A is a perspective view and FIG. 11B is a side view of a printing apparatus according to a first reception embodiment.
Figure 11B:
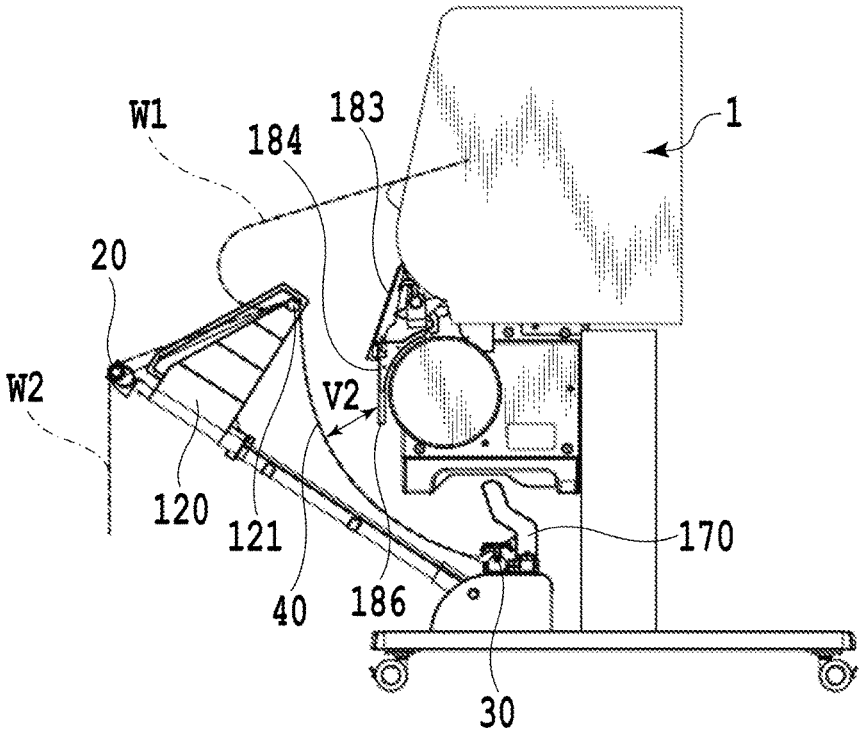

FIG. 11A is a perspective view and FIG. 11B is a side view of a printing apparatus according to a first reception embodiment. In this embodiment, the intermediate rod 121 is positioned on the side of the intermediate rod positioning members 120 close to the body 1. As shown in FIG. 11B, the flexible receiver 40 is held in a state of bowing downward by using the intermediate rod 121, the top rod 20, and the rear rod 30, thus forming the storage unit that stores sheets. Moreover, the receiver reeler 110 adjusts the length of the receiver 40 so as to define a clearance V2 between the sliding plates 186 and the receiver 40. Though the length of the receiver 40 is adjusted in this embodiment, it is also possible to secure the clearance V2 while stretching the receiver 40 to the maximum, and thus to eliminate the necessity for the length adjustment of the receiver 40 by stopping the receiver 40 halfway or the like. The flappers 183 are closed. The sliding plates 186 may be either moved up or moved down as long as the clearance V2 is successfully defined.

Next, a description will be given of behaviors of a sheet at the time of sheet discharge. A front end of a printed sheet W1 discharged from the discharge port 1*a* is guided to the sheet butting members 170 (that is, the first sheet butting portion) through the discharge port guide 1*b*, the flappers 183, the guides 184, and the sliding plates 186. Specifically, the sheet W1 is guided with its curling front end directed to the body 1, and the front end stops by coming into contact with the sheet butting members 170. As the sheet W1 is continuously conveyed in this state, a loop of the sheet W1 is formed on one side away from the body 1 while using the intermediate rod 121 as an inflection point. Thereafter, the sheet having been conveyed for a predetermined amount and then cut out is reversed by using the intermediate rod 121 as the inflection point, and is placed on the receiver 40 with its printed surface laid face-down like a sheet W2.

FIGS. 3B to 3E show modified examples of the first sheet butting portion. A description will be given below of configurations and usage examples thereof.

Figure 3B:
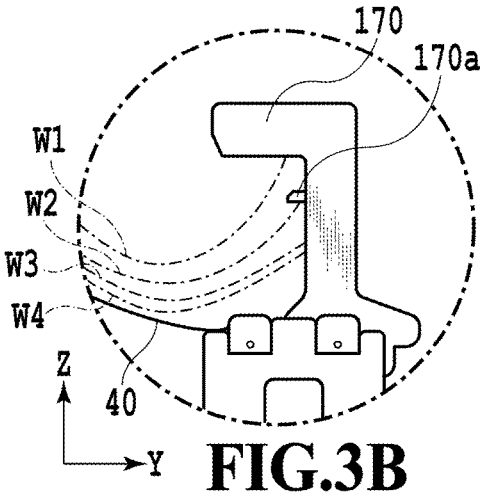

FIG. 3B is an enlarged diagram showing a modified example of the first sheet butting portion. The first sheet butting portion is formed as a laterally concave portion by using the sheet butting member 170 and the receiver 40. In addition, one projection 170*a* that can retain a state of regulating vertically upward movement of the front end portion of the sheet entering the first sheet butting portion is provided on a side surface on the inside (that is, an inner side surface) of the sheet butting member 170 where the sheet butts. In addition, FIG. 3B shows a state in which multiple sheets W1, W2, W3, and W4 butt the first sheet butting portion and get stacked. In this way, when the sheet has a weak curl, the front end of the sheet butts a surface of the sheet butting member 170. Thus, it is possible to stop the vertically upward movement of the front end of the sheet. When the sheet has a strong curl, the sheet tries to curl up more. In this case, it is possible to prevent the sheet from curling up by catching and stopping the front end of the sheet with the projection 170*a* at the time of butting. For this reason, this configuration is particularly effective in the case of the strongly curling sheet, or a strongly curling portion near the paper tube. Thus, it is possible to stack and store a large number of the strongly curling sheets that are hard to be stacked in nature. At this time, it is possible to conduct the stacking in accordance with a desired stacker specification by setting a height of the projection 170*a* equal to or above a value obtained by multiplying a maximum thickness of the sheet to be possibly used by a maximum number of the sheets to be possibly used. In this example, the height is set to 10 mm or more based on the assumption of multiplying the maximum thickness of 0.1 mm of typical plain paper by 100 sheets. If any thicker sheet or stacking of more sheets is taken into account, then an appropriate height may be set accordingly. In addition, by forming an inner upper surface of the sheet butting member 170 in such a way as to bulge in the Y direction from the projection 170*a*, the inner upper surface of the sheet butting member 170 can stop the sheets that the projection 170*a* fails to stop in case the number of fed sheets exceeds an estimated number.

In FIG. 3B, the projection 170*a* is provided on the inner side surface of the sheet butting member 170. Instead, the projection 170*a* may be provided on the inner upper surface thereof. In other words, the projection 170*a* only needs to be provided at least on any of the inner side surface and the inner upper surface of the sheet butting member 170.

Figure 3C:
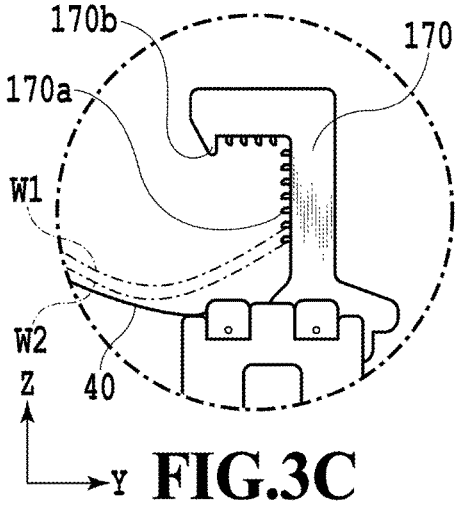
Figure 3D:
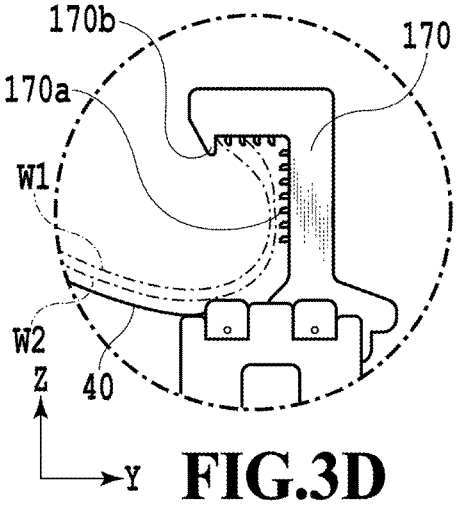

FIGS. 3C and 3D are enlarged diagrams showing another modified example of the first sheet butting portion. FIG. 3C shows a state of butting of a relatively weakly curling sheet, while FIG. 3D shows a state of butting of a relatively strongly curling sheet. Multiple projections 170*a* are arranged in the vertical direction on the inner side surface of the sheet butting member 170, while other multiple projections 170*a* are arranged in the Y direction on the inner upper surface thereof, and a projection 170*b* is formed at an end portion on a downstream side in the sheet discharge direction. Each projection 170*a* has a serrated shape provided with an inclined surface. The sheets W1 and W2 try to be rolled up owing to the curls thereof. Here, the front end of each sheet is caught and stopped by the corresponding projection 170*a*. Thus, the sheets are prevented from curling up. For this reason, this configuration is particularly effective in the case of the strongly curling sheet. Thus, it is possible to stack and store a large number of the strongly curling sheets that are hard to be stacked in nature. Accordingly, the multiple projections 170*a* are arranged on the inner upper surface and the inner side surface of sheet butting member 170 in consideration of the curls of the sheets W1 and W2, so that the projections 170*a* can suppress the curling up of the sheets irrespective of the butting positions of the discharged sheets. As shown in FIG. 3D, even in the case of a strongly curling sheet located near a winding core of the roll, the large projection 170*b* can stop the front end of the sheet. Specifically, regarding the heights of the multiple projections arranged on the inner upper surface of the sheet butting member 170, the projection 170*b* located on the most downstream side in the sheet discharge direction may be formed higher than the rest of the projections 170*a*. Each projection 170*a* has the serrated shape provided with the inclined surface such that a front end of a subsequently discharged sheet can easily reach a projection 170*a* adjacent to the former projection 170*a*. At this time, it is possible to conduct the stacking in accordance with a desired stacker specification by setting a sum of the heights of the projections 170*a* and the projection 170*b* equal to or above the value obtained by multiplying the maximum thickness of the sheet to be possibly used by the maximum number of the sheets to be possibly used. In this example, the sum of the heights is set to 10 mm or more based on the assumption of multiplying the maximum thickness of 0.1 mm of typical plain paper by 100 sheets. If any thicker sheet or stacking of more sheets is taken into account, then an appropriate height may be set accordingly.

In FIGS. 3C and 3D, the multiple projections 170*a* are arranged both on the inner upper surface and on the inner side surface of the sheet butting member 170. However, the projections 170*a* only need to be arranged at least on one of the inner upper surface and the inner side surface.

Figure 3E:
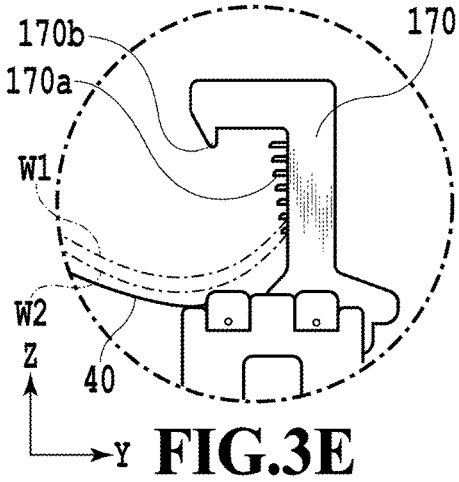

FIG. 3E is an enlarged diagram showing still another modified example of the first sheet butting portion. In the sheet butting portion of FIGS. 3C and 3D described above, the multiple projections 170*a* have the same shape. On the other hand, multiple projections 170*a* of this modified example have different heights. Specifically, the projections 170*a* on the inner side surface of the sheet butting member 170 may be formed such that the projection 170*a* located at a vertically upper part has a larger height. This configuration can achieve the following effect. Specifically, a portion of the rolled paper closer to the winding core has a stronger curl than that of a portion near the outer periphery thereof. Therefore, when multiple sheets are discharged, the degrees of the curl tend to be gradually increased. Accordingly, strongly curling sheets can butt the projections 170*a* properly by gradually increasing the heights thereof toward the downstream side in the sheet discharge direction. As a consequence, it is possible to increase an amount of the sheets to be stacked.

As described above, when each sheet is curling inward, the front end portion of the sheet that droops down from the discharge port 1*a* due to its own weight enters the first sheet butting portion, then butts the corresponding projection 170*a* to keep the stopping state, and then a subsequent portion of the sheet is discharged from the discharge port 1*a*.

Although the multiple projections 170*a* are arranged on the inner side surface of the sheet butting member 170 in FIG. 3E, the multiple projections 170*a* may be arranged on the inner upper surface instead. Specifically, the multiple projections 170*a* only need to be arranged at least on one of the inner upper surface and the inner side surface of the sheet butting member 170.

The first reception embodiment is an embodiment suitable for a sheet which is relatively large in size (such as A0 portrait). In this embodiment, it is possible to place multiple sheets while laying printed surfaces of the sheets face-down (face-down sheet discharge).

First Example of Second Reception Embodiment

Figure 12A:
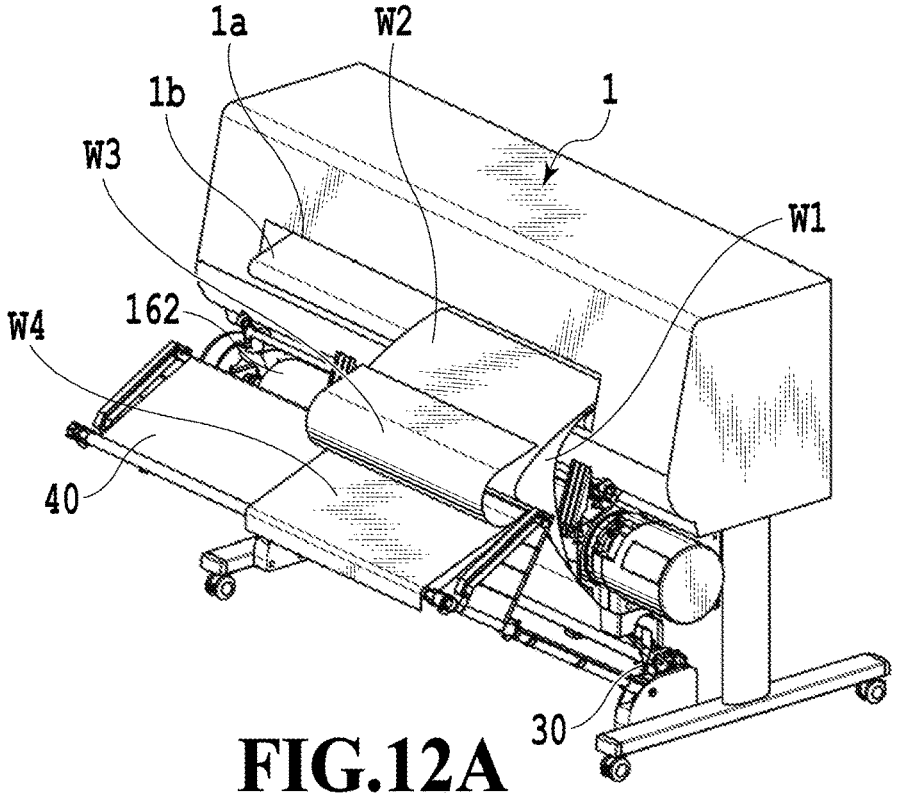
FIG. 12A is a perspective view and FIG. 12B is a side view of a printing apparatus according to a first example of a second reception embodiment.
Figure 12B:
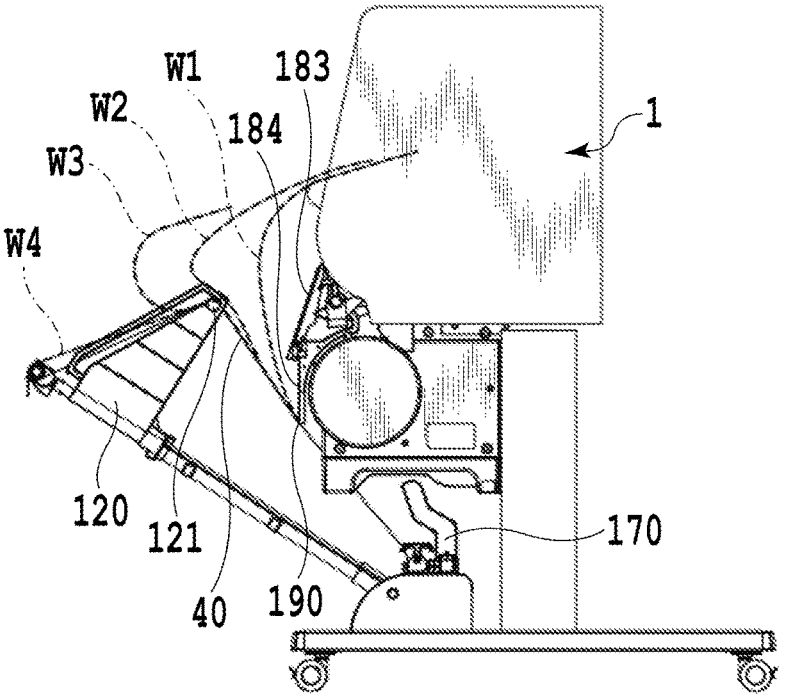

FIG. 12A is a perspective view and FIG. 12B is a side view of a printing apparatus according to a first example of a second reception embodiment. The printing apparatus of this embodiment is configured such that the receiver reeler 110 reels in the receiver 40 to reduce its length from the state in the above-described first reception embodiment, thereby bringing the receiver 40 into contact with the sliding plates 186 that are moved down. In other words, the receiver 40 is stretched so as to come into contact with the sliding plates 186. As a consequence, the clearance V2 between the receiver 40 and the sliding plates 186 disappears. As described above, the receiver 40 is brought into contact with the sliding plates 186 such that the receiver 40 does not interfere with the roll 162 set on the roll holder 161. In this way, there is formed a second sheet butting portion 190, which occludes a sheet discharge path (a storage path) to the sheet butting members 170 and thus receives the front end of the discharged sheet. Specifically, by coming into contact with the receiver 40, the sliding plates 186 function as a support unit (a second support unit) that supports the front end of the sheet at an intermediate position on the sheet storage path in the receiver 40 to the sheet butting members 170. At this time, the sliding plates 186 come into contact with an upper surface of the receiver 40 that corresponds to an inner surface of the storage unit. Specifically, the storage path is formed from a portion of the receiver 40 located between the intermediate rod 121 and the rear rod 30, and the sheet butting members 170 are located at a lower end of the storage path. Moreover, in this example, the storage portion is formed by the structure from the second sheet butting portion 190 to the top rod 20. Furthermore, the flappers 183 are closed in this example as well. Alternatively, the receiver 40 may be brought into contact with the guides 184 in the state where the sliding plates 186 are moved up. In other words, the sliding plates 186 and the receiver 40 need only be relatively attachable to and detachable from one another. In this context, the sliding plates 186 may be fixed while the receiver 40 may be configured to adjust its length. Alternatively, the sliding plates 186 may be movable upward while the length of the receiver 40 may be fixed.

To put it another way, each sliding plate 186 is a moving unit that is movable in the directions to come into contact with and to detach from the receiver 40. The second sheet butting portion 190 is a support portion formed at the intermediate position in a sheet storage direction of the receiver 40 and configured to support the front end portion of the sheet. Specifically, the support portion is formed in such a way as to adjust the position of the front end of the sheet in the case of storing a sheet that is short in length. On the other hand, when the support portion is not formed, the front end of the sheet travels downward beyond the guides 184 (or the sliding plates 186).

Next, a description will be given of behaviors of a sheet at the time of sheet discharge. A front end of a printed sheet W1 discharged from the discharge port 1*a* is guided to the second sheet butting portion 190 through the discharge port guide 1*b*, the flappers 183, the guides 184, and the sliding plates 186. Specifically, the sheet W1 is guided with its curling front end directed to the body 1, and the front end stops by coming into contact with the second sheet butting portion 190. In other words, the front end of the sheet W1 gets supported by the second sheet butting portion 190. As the sheet W1 is continuously conveyed in this state, a loop of the sheet is formed on one side away from the body 1 while using the intermediate rod 121 as an inflection point, which is illustrated as a transition from a sheet W2 to a sheet W3. Thereafter, the sheet having been conveyed for a predetermined amount and then cut out is reversed by using the intermediate rod 121 as the inflection point, and is placed on the receiver 40 with its printed surface laid face-down like a sheet W4. In other words, the second sheet butting portion functions as the support unit that supports the front end of the sheet, and the sheet is discharged while being supported by the support unit. Alternatively, the receiver reeler 110 may be provided to the rear rod 30 instead, and the receiver 40 need only be stretched while being rolled around at least one of the top rod 20 and the rear rod 30.

The first example of the second reception embodiment is an embodiment suitable for a sheet (such as A1 portrait) which is smaller than the sheet in the above-described first reception embodiment. In this embodiment, it is possible to place multiple sheets while laying printed surfaces of the sheets face-down (face-down sheet discharge).

Second Example of Second Reception Embodiment

Figure 13A:
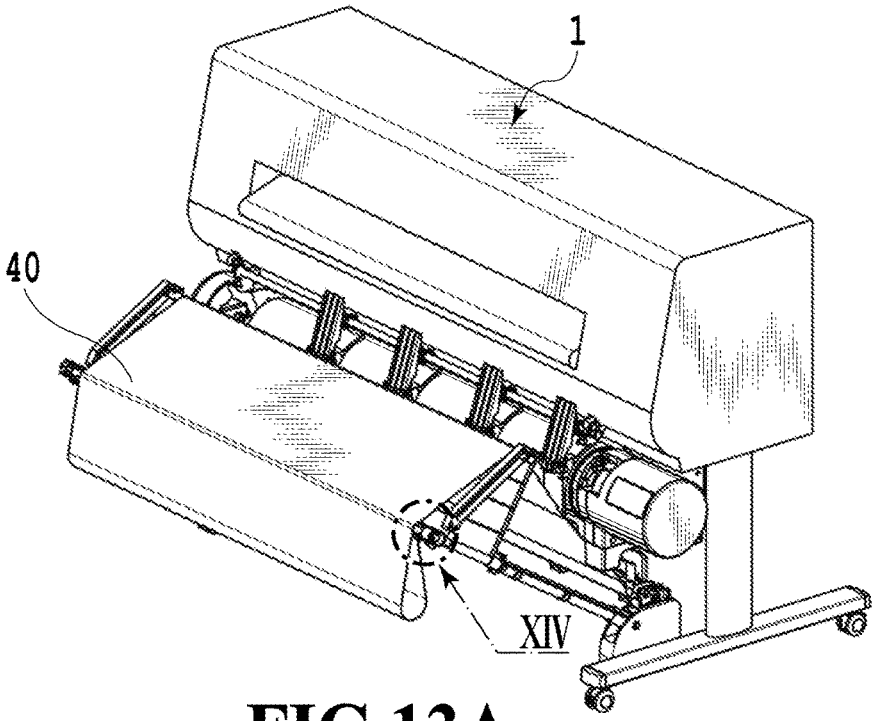
FIG. 13A is a perspective view and FIG. 13B is a side view of a printing apparatus according to a second example of the second reception embodiment.
Figure 13B:
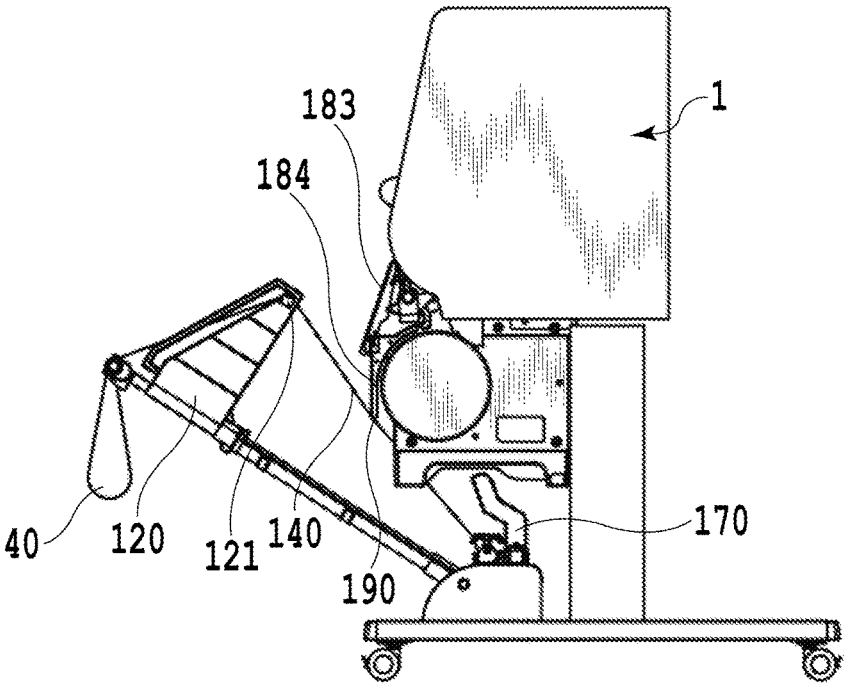
Figure 14:
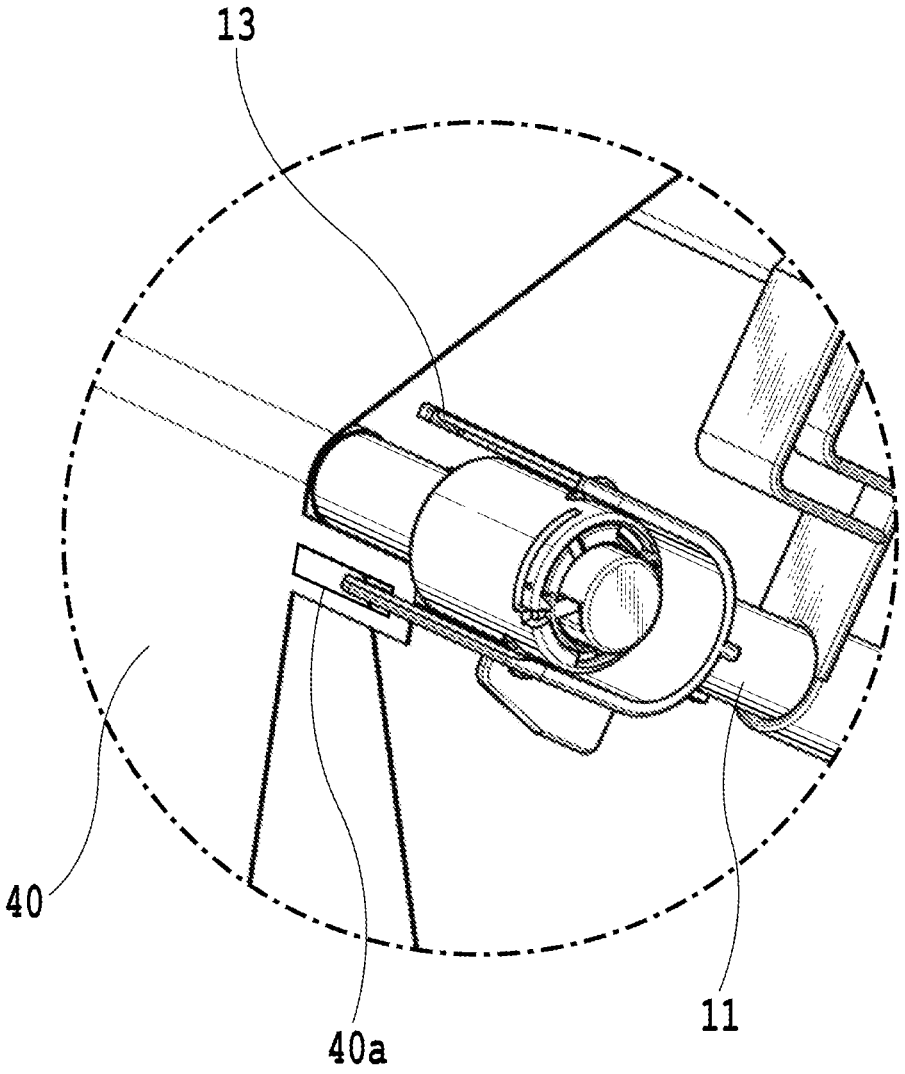
FIG. 14 is a perspective view for explaining a receiver folder of the printing apparatus of FIGS. 13A and 13B.

FIG. 13A is a perspective view and FIG. 13B is a side view of a printing apparatus according to a second example of the second reception embodiment. FIG. 14 is a perspective view for explaining a receiver folder of the printing apparatus of FIGS. 13A and 13B, which is an enlarged view of a portion XIV surrounded by a broken line in FIG. 13A. Here, a description will be given of different features from those in the above-mentioned first example of the second reception embodiment.

The printing apparatus of this example is configured to be capable of folding the flexible receiver 40 and adjusting the length thereof. As shown in FIG. 14, the receiver 40 of this example includes multiple holes 40*a* provided at end portions of the receiver 40, so that one of the holes 40*a* can be fitted on a catch (not shown) of each joint member 13 provided at a front end of each side rod 11. In this way, it is possible to fold the receiver 40 to adjust the length thereof, and to bring the receiver 40 into contact with any of the guides 184 and the sliding plates 186. Note that the method of adjusting the length of the receiver 40 is not limited to this example. For instance, the receiver 40 may include a component that can establish face-to-face attachment or detachment such as a hook-and-loop fastener. Alternatively, the receiver folder may be provided to the rear rod 30 instead, and the receiver 40 need only be stretched while being fitted in a folded state on at least one of the top rod 20 and the rear rod 30.

Behaviors of a sheet at the time of sheet discharge are the same as those in the above-described first example. According to this example, it is possible to omit the receiver reeler 110 from the above-described first example, and thus to simplify the configuration of the apparatus.

(Third Example of Second Reception Embodiment)

Figure 15:
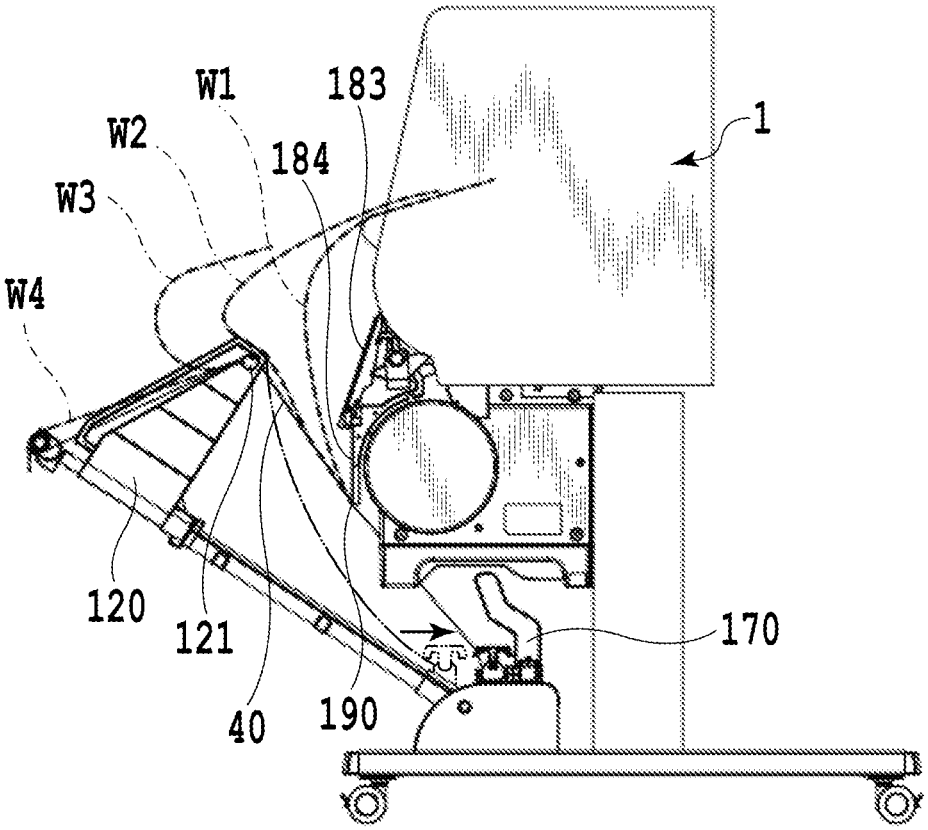
FIG. 15 is a side view of a printing apparatus according to a third example of the second reception embodiment.

FIG. 15 is a side view of a printing apparatus according to a third example of the second reception embodiment. Here, a description will be given of different features from those in the above-mentioned first example of the second reception embodiment. The printing apparatus of this example is configured such that a position of each rear rod holding member 31 shown in FIG. 3A is movable toward the back of the body 1. It is also possible to move the rear rod 30 on which the receiver 40 is fitted, by moving the rear rod holding members 31 toward the back of the body 1. The receiver 40 is pulled in this way. As a consequence, it is possible to stretch the receiver 40 so as to come into contact with the sliding plates 186 as with the case of reducing the length of the receiver 40 in the first example of the second reception embodiment.

Alternatively, the receiver 40 may possibly be stretched so as to come into contact with the sliding plates 186 by using the intermediate rod 121, which is movable by using the intermediate rod positioning members 120, as an inflection point.

Behaviors of a sheet at the time of sheet discharge are the same as those in the aforementioned first example of the second reception embodiment. According to this example, it is possible to omit the receiver reeler 110 from the above-described first example of the second reception embodiment, and thus to simplify the configuration of the apparatus as with the above-described second example of the second reception embodiment. The configuration of this example may be combined with the printing apparatus according to the aforementioned first example of the second reception embodiment.

As described above, according to this reception embodiment, it is possible to adjust the position of the front end of the sheet by using a smaller storage mechanism, and to achieve a storage embodiment that can also store a sheet that is short in length.

Third Reception Embodiment

Figure 16A:
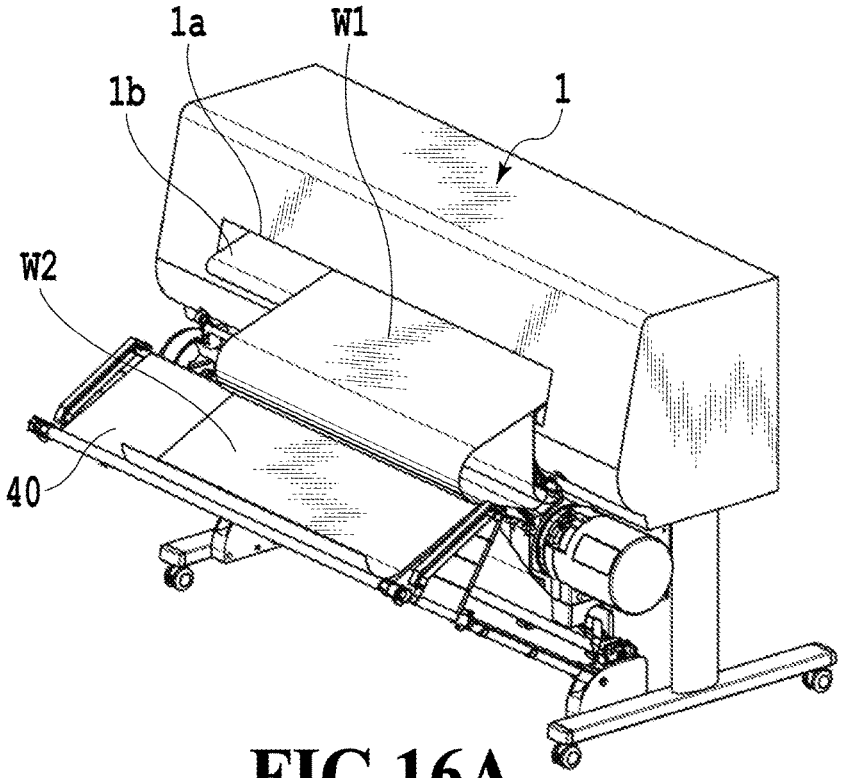
FIG. 16A is a perspective view and FIG. 16B is a side view of a printing apparatus according to a third reception embodiment.
Figure 16B:
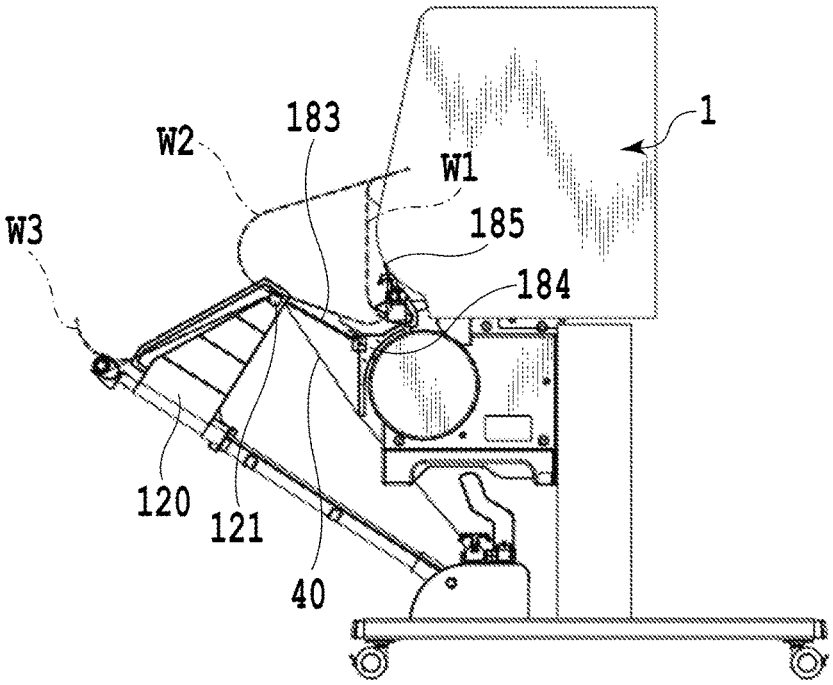

FIG. 16A is a perspective view and FIG. 16B is a side view of a printing apparatus according to a third reception embodiment. The printing apparatus of this embodiment is configured such that the flappers 183 are in an open state in contrast with the first example of the second reception embodiment. At this time, the front end portion 183*a* of each flapper 183 is located in the vicinity of the intermediate rod 121, whereby a sheet discharge path to the second sheet butting portion 190 is occluded as shown in FIG. 16B. The intermediate rod 121 functions as a support member that can support the sheet through the receiver 40. Moreover, the sheet receiving unit (the storage unit) forms an upward convex shape (inverted v-shape) in conjunction with the flappers 183 in the open state and the receiver 40 stretched from the top rod 20 to the intermediate rod 121. Specifically, upper surfaces of the flappers 183 in the open state and the upper surface of the stretched receiver 40 form the upward convex shape (inverted v-shape). Moreover, as described later, the stretched receiver 40 functions as a support unit that supports a rear end side of a sheet placed on the sheet receiving unit.

Next, a description will be given of movement of a sheet at the time of sheet discharge. A front end of a printed sheet W1 discharged from the discharge port 1*a* is guided by the discharge port guide 1*b*, the sheet guide 185, and the guides 184, thus butting and stopping at the concave portions of the guides 184. Specifically, the concave portion of each guide 184 receives the front end of the sheet W1 and regulates the position of the front end of the sheet W1. Then, as the sheet W1 is continuously conveyed in the state of the front end of the sheet W1 being regulated by the concave portions, the front end portion of the sheet W1 is discharged while being supported by the flappers 183. Hence, a loop of the sheet W is formed on one side away from the body 1 like a sheet W2 while using the intermediate rod 121 as an inflection point. Thereafter, the sheet having been conveyed for a predetermined amount and then cut out is reversed by using the intermediate rod 121 as the inflection point, and is placed with its printed surface laid face-down like a sheet W3. In other words, the receiver 40 stretched from the top rod 20 to the intermediate rod 121 functions as a support unit that supports a rear end side of the sheet W3. This embodiment is suitable for a sheet (such as A1 landscape and A2 landscape) which is smaller than the sheets in the above-described first reception embodiment and the second reception embodiment. In this embodiment, it is possible to place multiple sheets while laying printed surfaces face-down (face-down sheet discharge).

Next, with reference to FIGS. 10A and 10B again, a description will be given of behaviors at the time of discharge of a sheet having a front end that is strongly curling inward. In the case where the sheet is curling inward, when the front end portion of the sheet butts the concave portion of the guide 184, a force that promotes curling up in a direction away from the body 1 acts on the front end of the sheet due to the curl. Accordingly, if the sheet is continuously conveyed in this state, the sheet starts curling up from the front end. However, the convex portion 184*d* in the projecting shape that is directed downward is provided in the vicinity of the opening on the upper surface of the concave portion of the guide 184. As a consequence, the front end portion of the sheet gets caught on the convex portion 184*d* in the projecting shape after entering the concave portion, and comes into engagement with the convex portion 184*d* in the projecting shape. The sheet is discharged from the discharge port with its front end portion being engaged with the convex portion 184*d* in the projecting shape. Accordingly, it is possible to inhibit the front end of the sheet from curling up. On the other hand, each of the reception members in the printing apparatus of Japanese Patent Laid-Open No. 2015-189522 is not provided with a convex portion in a projecting shape for suppressing the curl-up. For this reason, this printing apparatus may cause a placement or storage failure at the time of discharge of a sheet having a front end that is strongly curling inward. As described above, according to this example, it is possible to place and store a sheet having a front end that is strongly curling inward.

The length of the clearance V1 described above is defined to be greater than the sum of the thickness of the maximum number of loaded sheets and the maximum value of the curling amount of the front end of the sheet. The maximum value of the curling amount of the front end of the sheet is equivalent to the distance from the lowermost surface of the sheet in the state of drooping vertically downward to the front end of the sheet that is warped vertically upward to the maximum. In this way, even when placing the maximum number of sheets each having strongly curling front end, it is possible to place and store the sheets without causing any jams of the front ends of the sheets at an entrance of each guide 184 (the clearance V1).

As described previously, each guide 184 is formed such that the length in the sheet discharge direction of the second regulating surface 184*b* is smaller than the radius of the paper tube. Specifically, the length in the depth direction of the upper surface of the concave portion is made shorter than an inside diameter of the roll where unused sheets are wound around. The height of the convex portion 184*d* (that is, the amount of protrusion from the upper surface of the concave portion) is formed greater than the maximum thickness of the sheet expected for use. In this way, even in the case of placing the sheet having the front end that is strongly curling inward, it is possible to prevent the sheet from curling up since the front end of the sheet is reliably caught on the convex portion 184*d* before the front end exceeds the center line of the curl.

Moreover, the multiple guides 184 each including the flapper 183 and a curl regulation mechanism (the concave portion) are disposed in the sheet width direction as shown in FIG. 8A, for example. The concave portions are provided corresponding to the multiple flappers, respectively. Since two side portions in the width direction of the front end of the sheet have particularly strong curls, the guides 184 may be disposed at positions corresponding to the two side portions of the front end of the sheet, respectively, in order to reliably regulate the curls at the two side portions. In other words, the concave portions serving as the curl regulation mechanisms may be provided at least at two positions corresponding to the two side portions in the width direction of the sheet expected for use. The guides 184 are attachably and detachably provided.

Figure 10B:
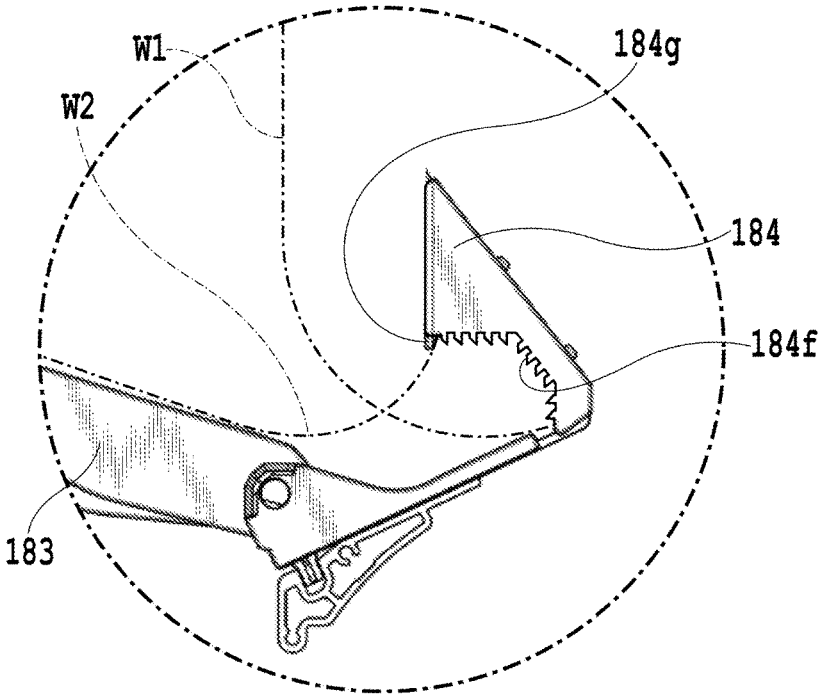

Furthermore, FIG. 10B shows another example of the guide 184 in FIG. 10A. Unlike the configuration illustrated in FIG. 10A, the guide 184 of FIG. 10B is provided with multiple projections 184*f* as with the first sheet butting portion shown in FIGS. 3C and 3D. Specifically, the multiple projections 184*f* are formed on the above-mentioned regulating surfaces (namely, the inner upper surface and the inner side surface) of the guide 184, respectively, and a projection 184*g* having the largest height is provided at an end portion on a downstream side in the sheet discharge direction. According to this configuration, the guide 184 can achieve an effect similar to that of the first sheet butting portion of FIGS. 3C and 3D.

Fourth Reception Embodiment

Figure 17A:
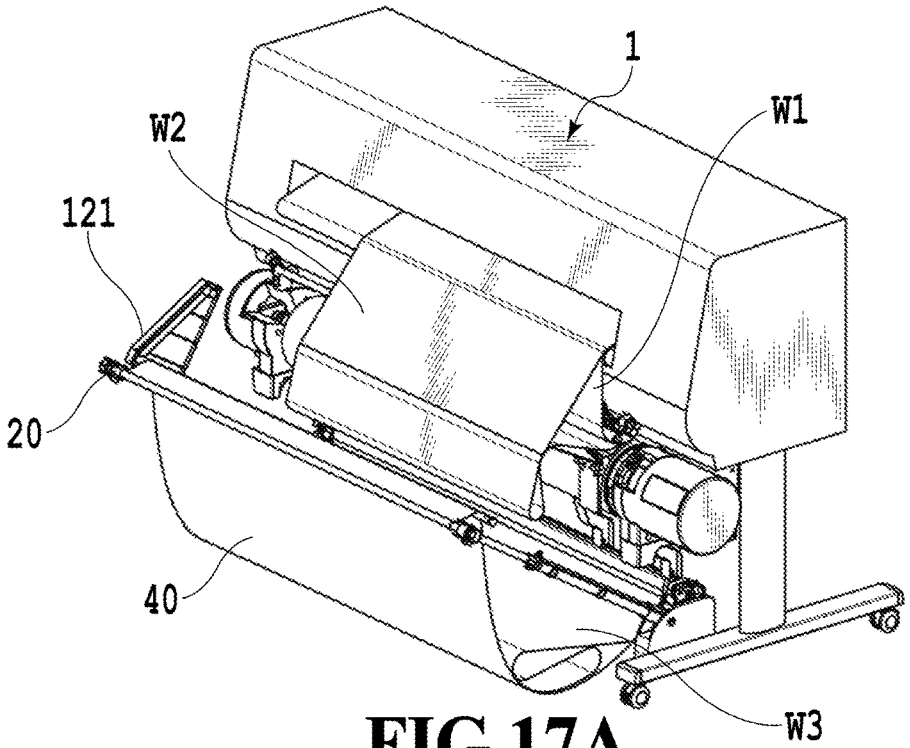
FIG. 17A is a perspective view and FIG. 17B is a side view of a printing apparatus according to a fourth reception embodiment.
Figure 17B:
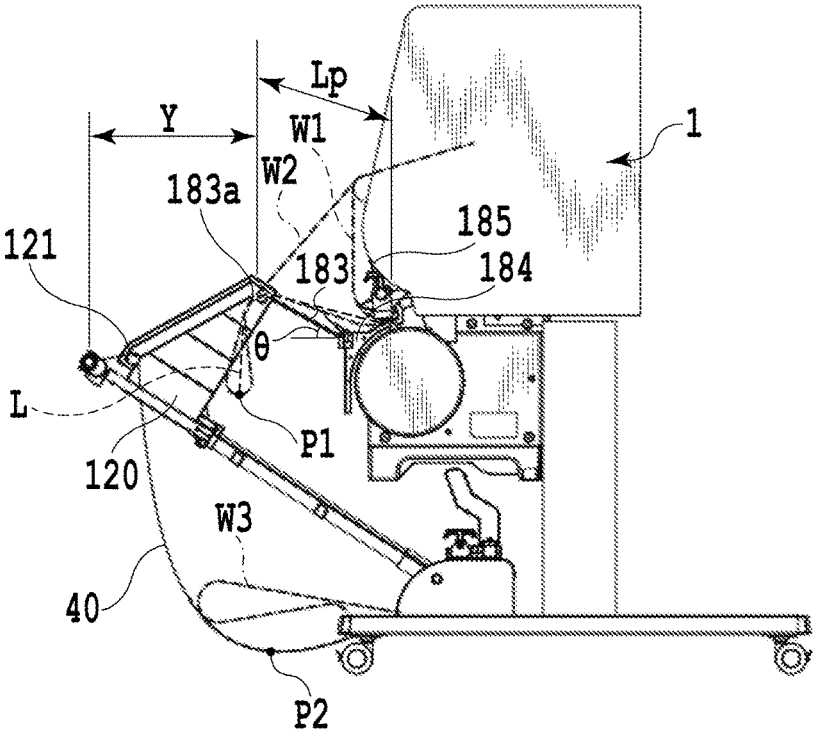

FIG. 17A is a perspective view and FIG. 17B is a side view of a printing apparatus according to a fourth reception embodiment. Note that illustration of one of the intermediate rod positioning members 120 is omitted in FIG. 17A in order to facilitate the understanding.

The printing apparatus according to the fourth reception embodiment is configured such that the intermediate rod 121 is moved closer to the top rod 20 as compared to the third reception embodiment. As a consequence, the flexible receiver 40 gets loose and curved by its own weight, thereby forming a bag shape that can receive the entire sheet. Thus, the storage unit is formed into a bag shape. Specifically, in the sheet basket 3, the receiver 40 with the one end portion fixed to the top rod 20 and the other end portion fixed to the rear rod 30 through the intermediate rod 121 is curved by its own weight, and a lowermost point P2 located lowest is situated below the rear rod 30. Since the intermediate rod 121 is moved toward the top rod 20, a space defined by the receiver 40 is formed wide in terms of the depth direction (the front-back direction). Note that in this embodiment, the flappers 183 are in the state of being open and protruding to a space between the discharge port 1*a* and the storage unit formed from the flexible receiver 40. In other words, the storage unit is designed to encompass a region located below the flappers 183 in the open state in terms of the direction of gravitational force. Thus, a sheet storage space in the storage unit is formed below the flappers 183.

Next, a description will be given of behaviors of a sheet at the time of sheet discharge. As with the above-described third reception embodiment, a front end of a printed sheet W1 discharged from the discharge port 1*a* is guided by the discharge port guide 1*b* and the sheet guide 185, thus butting and stopping at the first regulating surfaces 184*a* in the concave portions of the guides 184. Then, as the sheet W1 is continuously conveyed in the state where the front end of the sheet W1 is regulated by the concave portions, the sheet W1 is guided while being supported by the flappers 183. Hence, a loop of the sheet is formed vertically downward like a sheet W2 while using the front end portions 183*a* of the flappers 183 as an inflection point, and a successive portion of the sheet droops down into the storage space while forming a loop. At this time, the loop that droops down from the front end portions 183*a* does not come into contact with other components such as the receiver 40. Thereafter, the sheet having been conveyed for a predetermined amount while retaining the loop state and then cut out falls in the bag-shaped receiver 40, and is placed in a loosely folded state like a sheet W3.

What is important here is that the front end portion including the front end of the sheet before being cut out is located on the guides 184 and the flappers 183, and the sheet is stored and placed on the receiver 40 after being cut out. A rear end of the sheet before being cut out is held by the body 1. Accordingly, the center of gravity of the sheet is located closer to the body 1 than the front end portions 183*a* of the flappers 183 are. For this reason, the sheet in the state of drooping vertically downward by use of the front end portions 183*a* as the inflection point and thus being formed into the loop is kept from falling, and the front end portion of the sheet is located on the guides 184 and the flappers 183. Thereafter, when the sheet is cut out, the rear end of the sheet is no longer held by the body 1 and the center of gravity of the sheet transitions to a position which is more distant from the body 1 than the front end portions 183*a* of the flappers 183 are. For this reason, the sheet falls onto the receiver 40 from a portion near an intermediate part of the sheet formed into the loop due to its own weight, and is stored in a loosely folded state while retaining the loop shape.

In this case, the upper surface (a support surface that supports the front end portion of the sheet) of each flapper 183 is preferably horizontal or inclined upward away from the body 1 and the discharge port 1*a* because, if each flapper 183 is inclined downward, the center of gravity of the sheet is apt to move in a direction away from the body 1 when the sheet forms the loop, and the sheet may fall onto the receiver 40 before being cut out. In consideration of consistency with other embodiments, this example adopts the shape of the upper surface of each flapper 183, which is inclined upward to the front end of the flapper 183.

As described above, in the sheet basket 3, the intermediate rod 121 is moved toward the top rod 20, and the storage unit of the receiver 40 formed into the bag shape is located in the region including an area below the flappers 183 in terms of the direction of gravitational force. Accordingly, it is possible to form the loop drooping down from the front end portions 183*a* of the flappers 183 without causing interference with other components. On the other hand, according to the printing apparatus of Japanese Patent Laid-Open No. 2015-189522, for example, the first reception members and the second reception members are set to a substantially horizontal state, and the storage unit is formed by loosening a sheet member (corresponding to the receiver) between an arm portion located on a front side of the second reception members and front end portions of the first reception members. Therefore, according to the technique disclosed in Japanese Patent Laid-Open No. 2015-189522, the sheet which is discharged while being supported by the second reception members may occasionally form a loop in the storage unit, but this loop is in contact with the arm portion and the sheet member. Then, the sheet which is cut out rolls down due to a curl or the like and gets stored in the storage unit. In this regard, if the sheet has low rigidity or has a weak curl, for example, the sheet may curl up and the storage unit cannot store this sheet. On the other hand, in the sheet basket 3, the loop is formed in a drooping manner at the front end portions 183*a* without being interfered with other components. Accordingly, when the sheet is cut out, the sheet falls while keeping its loop shape and is then loosely folded and stored by use of the loop shape. For this reason, if the sheets are stored continuously, the sheets are placed in the loosely folded state. In this way, as compared to the technique disclosed in Japanese Patent Laid-Open No. 2015-189522, the sheet basket 3 is capable of achieving the effective use of a space in the height direction of the storage unit, storing more sheets, and storing the sheets more reliably in the storage unit irrespective of the degrees of curls or lengths of the sheets. Note that the fourth reception embodiment is assumed to be applied mainly to plain paper and coated paper in standard sizes such as A0 and B0 frequently used in drawings, posters, and the like. However, the application of this embodiment is not limited only to these standard sizes. This embodiment is also capable of storing sheets in two or more sizes at the same time.

Figure 18:
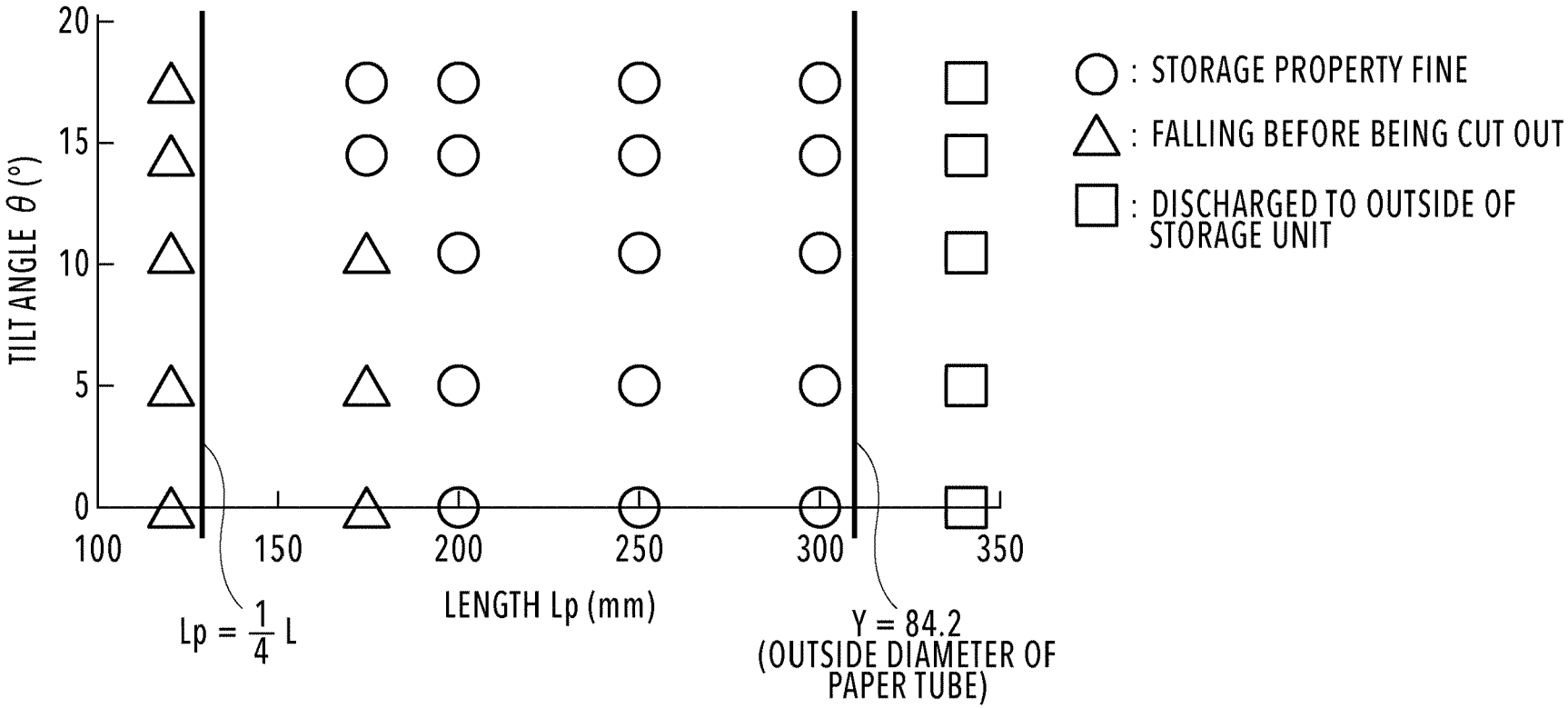
FIG. 18 is a diagram showing experimental data for determining a length of a section defined between an upper surface of a flapper and an upper surface of a guide in the printing apparatus according to the fourth reception embodiment.

Here, FIG. 18 shows experimental results of investigation about a state of fall of the sheet varying depending on a tilt angle of each flapper 183 and on a length of the sheet located on the flappers 183 and the guides 184. In FIG. 18, a length Lp represents a length from the concave portion of each guide 184 to the front end portion 183*a* of each flapper 183. A length L represents a length from the front end of the sheet regulated by the concave portions formed in the guides 184 to a lower end P1 of the loop drooping down through the front end portions 183*a*. A tilt angle θ of each flapper 183 is calibrated to "0" when the flapper 183 extends horizontally, and represents an angle of the upward inclination of the upper surface of the flapper 183. A length Y represents a length in the depth direction (the front-back direction) of between each front end portion 183*a* and the top rod 20, that is, a length in the horizontal direction from an upper front end portion of the storage unit to the front end portions 183*a*. Note that the lengths Lp, L, and Y as well as the tilt angle θ are illustrated in FIG. 17B.

When the length Lp is less than ¼L, the center of gravity of the sheet before being cut out is located at a position further away from the body 1 than the front end portions 183*a* of the flappers 183 are, whereby the sheet located on the flappers 183 and the guides 184 falls in the storage unit before being cut out. For this reason, the length Lp is preferably equal to or more than ¼ times as large as the length L. This makes it possible to locate the center of gravity of the sheet before being cut out closer to the body 1 than the front end portions 183*a* are.

Moreover, the length Lp is preferably less than the length Y. Here, if the length Y is less than an outside diameter of the paper tube of the housed roll (that is, the inside diameter of the roll), the sheet is liable to be discharged to the outside of the storage unit due to the curl of the sheet and the like. Accordingly, the length Y is preferably set larger than the outside diameter of the paper tube of the housed roll. This makes it possible to store the sheet, which is formed into the loop, on the receiver 40 without dropping off the storage unit.

In this fourth reception embodiment, when the receiver 40 is formed into the bag shape, it is preferable to locate the lowermost point P2 of the receiver 40 closer to the body 1 (on the back side) than the lower end P1 of the loop drooping down from the front end portions 183*a* is. Alternatively, the lowermost point P2 may be located away from the body 1 (on the front side) than the lower end P1 is. In other words, it is preferable to incline the inner surface of the receiver 40, namely, the inner surface of the storage unit at a portion below the lower end P1 in terms of the direction of gravitational force, based on a positional relation between the lowermost point P2 and the lower end P1. Thus, the sheet that is cut out and falls while retaining the loop shape is loosely folded by use of the inclined surface formed by the receiver 40 while efficiently using the loop shape.

First Example of Fifth Reception Embodiment

Figure 19A:
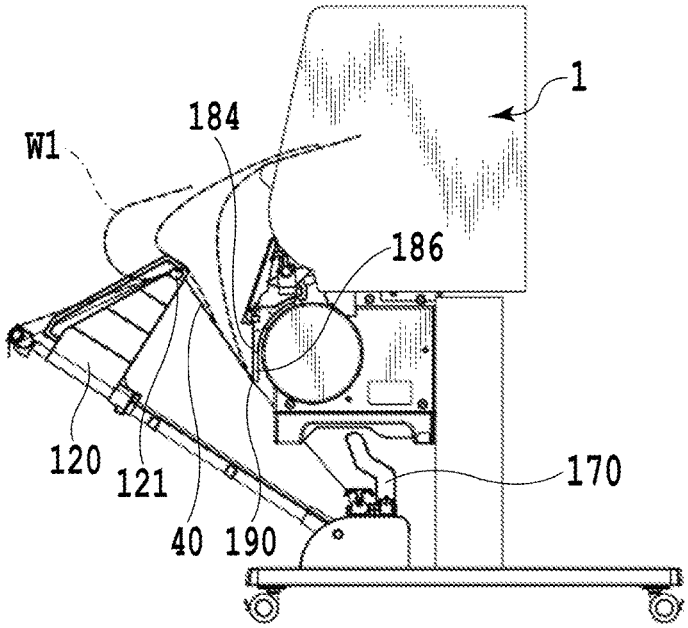
FIG. 19A is a side view.
Figure 19B:
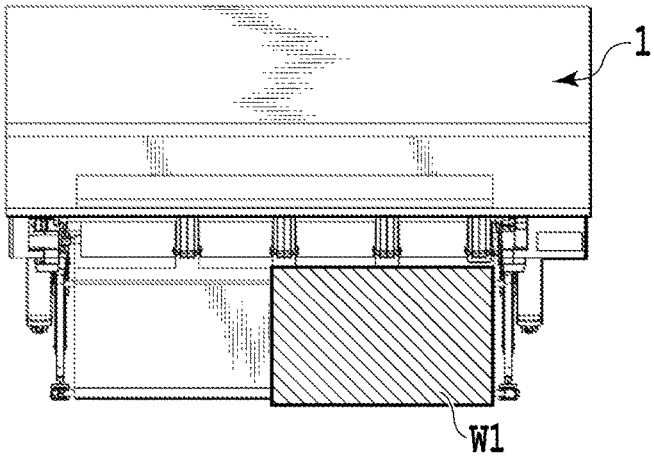
FIG. 19B is a top view.
Figure 19C:
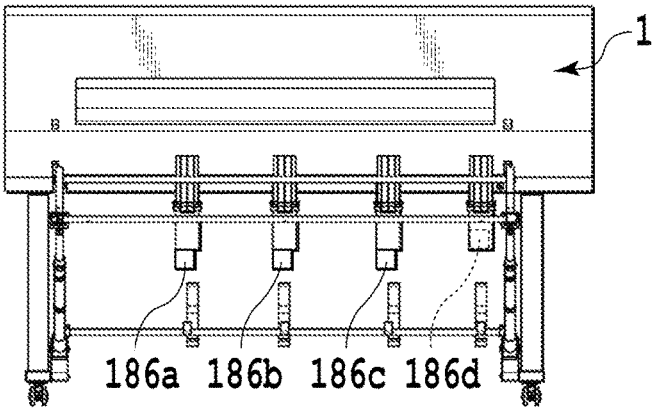
FIG. 19C is a front view of a printing apparatus according to a first example of a fifth reception embodiment.

FIG. 19A is a side view, FIG. 19B is a top view, and FIG. 19C is a front view of a printing apparatus according to a first example of a fifth reception embodiment. Note that illustration of the receiver 40 is omitted in the front view of FIG. 19C in order to facilitate the understanding of the configuration of components behind the receiver 40. In the printing apparatus of this embodiment, the user conducts an operation to move the respective sliding plates 186 up and down from the state of the first example of the second reception embodiment and depending on the sizes of the sheets to be discharged. Specifically, a sliding plate 186*d* on the right end out of the multiple sliding plates 186*a* to 186*d* is moved up as shown in FIG. 19C. Thus, it is possible to partially open the second sheet butting portion 190 and to convey a sheet smaller than a predetermined width to the first sheet butting portion formed from the sheet butting members 170.

Next, a description will be given of behaviors of a sheet at the time of sheet discharge. Note that a sheet reference end (a reference position) to define a position serving as a reference when a sheet is discharged from the discharge port 1*a* is set to the right side in the sheet width direction in this embodiment. As described above, the user sets about the operation to move at least one of the sliding plates 186 up and down starting from the right side in the sheet width direction depending on the size of the sheet to be discharged. In FIG. 19C, the first sliding plate 186*d* on the right is moved up while the second, third, and fourth sliding plates 186*a* to 186*c* from the right are moved down. In other words, the sliding plates 186*a* to 186*c* that are moved down, and the receiver 40 collectively form the second sheet butting portion 190 similar to the one in the first example of the second reception embodiment.

In this state, when a sheet W1 (such as A1 portrait or larger) which is larger than a predetermined width is discharged as shown in FIG. 19B, the front end of the sheet butts the second sheet butting portion 190 as with the first example of the second reception embodiment. As the sheet W1 is continuously conveyed in this state, the sheet W1 is reversed by using the intermediate rod 121 as an inflection point, and is stored with its printed surface laid face-down. In this example, a position of contact between the front end of the sheet and the second sheet butting portion 190 is smaller than that in the second reception embodiment. Accordingly, a force that acts to slant the sheet is increased at the time of storage. Nonetheless, the intermediate rod positioning members 120 can play a role as guides and minimize the force that acts to slant the sheet.

Figure 20A:
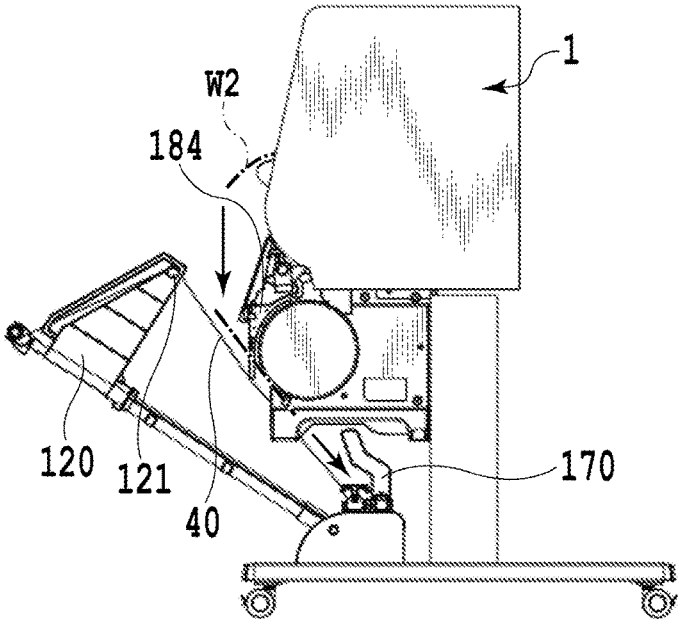
FIG. 20A is a side view and FIG. 20B is a top view for explaining a behavior of a sheet smaller than a predetermined width in the printing apparatus of FIGS. 19A, 19B and 19C.
Figure 20B:
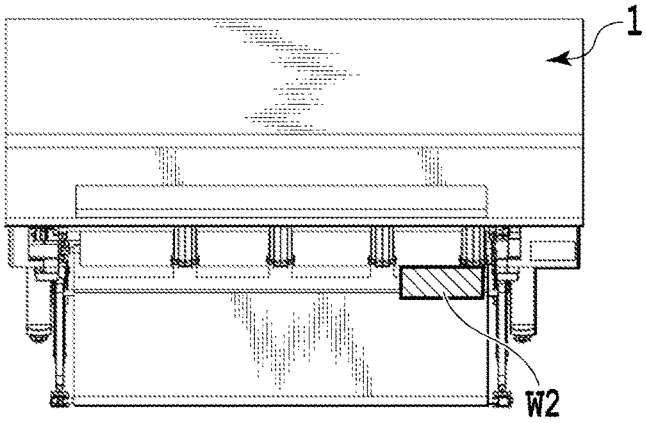

On the other hand, when a sheet W2 (such as A2 portrait or smaller) which is smaller than the predetermined width is discharged as shown in FIGS. 20A and 20B, the sheet W2 passes through a gap formed between the receiver 40 and the sliding plate 186*d* that is moved up. Furthermore, the sheet butts the sheet butting members 170 located below the body 1 and gets placed on the receiver 40. Thus, the printing apparatus of this example is capable of sorting and storing the sheets in different sizes with a simple user operation.

Although this example has been described above while setting the sheet reference end to the right side in the sheet width direction, the present invention is not limited only to this configuration. For instance, if the sheet reference end is set to the left side in the sheet width direction, then the user may conduct an operation to move at least one of the sliding plates 186 up and down from the left side in the sheet width direction. If the sheet reference end is set to the center in the sheet width direction, then the user may conduct an operation to move at least one of the sliding plates 186 up and down from the center in the sheet width direction. Although the second sheet butting portion 190 is formed by bringing the sliding plates 186 into contact with the receiver 40 at the intermediate position on the storage path, the present invention is not limited only to this configuration. For example, a member being attachable to and detachable from the receiver 40 may be provided at the intermediate position, and the member may be fitted on the receiver 40 as needed such that the member regulates and supports the front end of the sheet.

As described above, this example is configured to sort and store the sheets in different sizes by conducting the operation to move the sliding plates 186 up and down. However, the present invention is not limited only to this configuration. Specifically, the flappers 183 may be opened or closed or the detachably provided guides 184 may be removed depending on the sizes of the sheets to be discharged. To be more precise, when storing the above-mentioned sheets W1 and W2, the flappers 183 of the guides 184 having the sliding plates 186*a* to 186*c* are set to an open state, and the flapper 183 of the guide 184 having the sliding plate 186*d* is set to a closed state. Alternatively, the sliding plates 186*a* to 186*c* are moved down to come into contact with the receiver 40, and the guide 184 having the sliding plate 186*d* is removed.

(Second Example of Fifth Reception Embodiment)

Figure 21A:
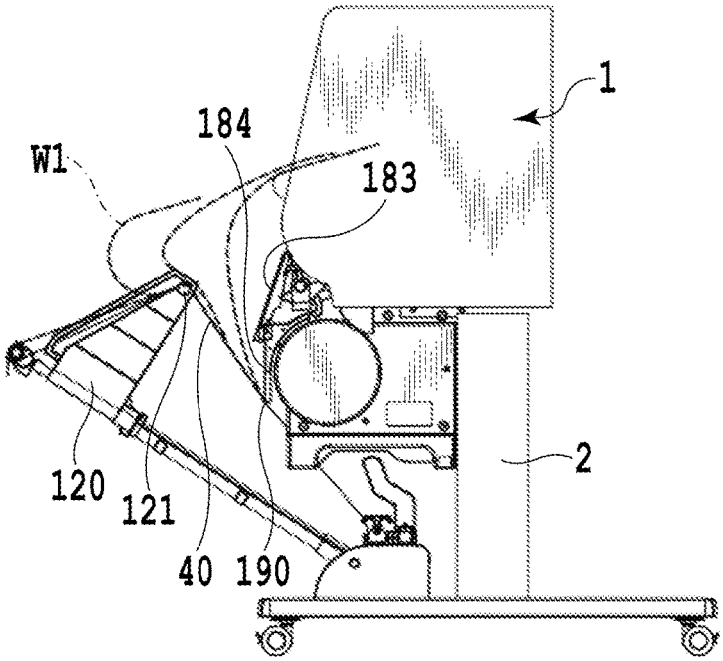
FIG. 21A is a side view.
Figure 21B:
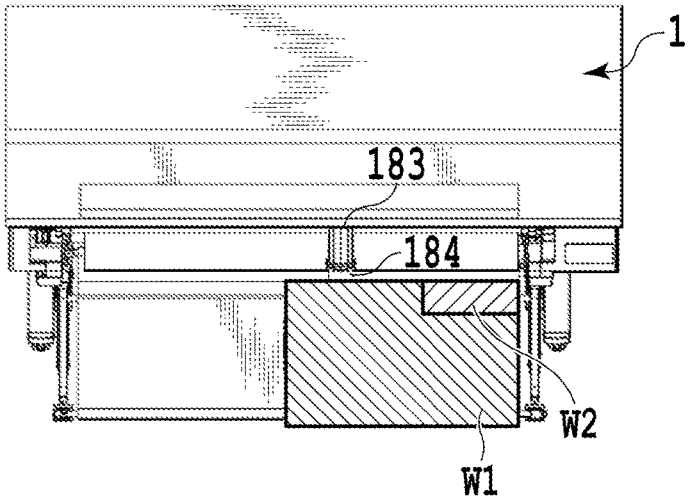
FIG. 21B is a top view.
Figure 21C:
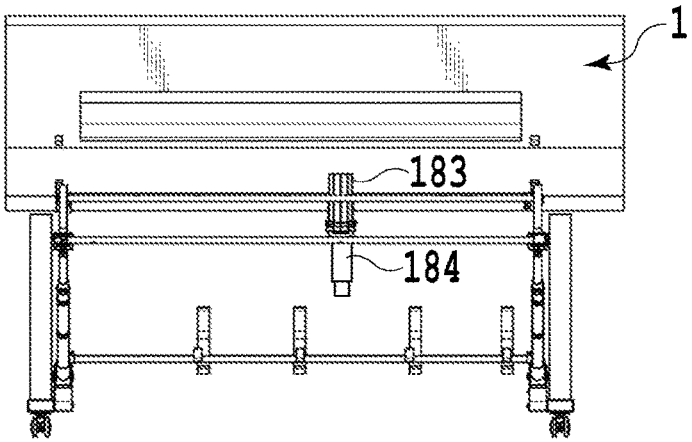
FIG. 21C is a front view of a printing apparatus according to a second example of the fifth reception embodiment.

FIG. 21A is a side view, FIG. 21B is a top view, and FIG. 21C is a front view of a printing apparatus according to a second example of the fifth reception embodiment. Note that illustration of the receiver 40 is omitted in the front view of FIG. 21C in order to facilitate the understanding of the configuration of components behind the receiver 40. In the following, a description will be given of different features between the printing apparatus of this example and the printing apparatus according to the above-described first example of the fifth reception embodiment. As shown in FIGS. 21B and 21C, a single guide 184 is attachably and detachably provided to the printing apparatus of this example. An installation position of the guide 184 is located inside (the right side on the sheet surface of FIGS. 21B and 21C) of the width of a sheet W1 (such as A1 portrait or larger) which is larger than a predetermined width and outside (the left side on the sheet surface of FIGS. 21B and 21C) of the width of a sheet W2 (such as A2 portrait or smaller) which is smaller than the predetermined width. Moreover, since the guide 184 is attachable to and detachable from the guide rod 182, the user can change the installation position depending on the sizes of the sheets.

Behaviors of a sheet at the time of sheet discharge of this example are similar to those of the above-described first example of the fifth reception embodiment. In this example, the guide 184 is configured to be attachable and detachable. Instead, the guide 184 may be configured to be movable in the sheet width direction so as to allow the user to move the guide 184 depending on the sizes of the sheets.

Third Example of Fifth Reception Embodiment

Figure 22A:
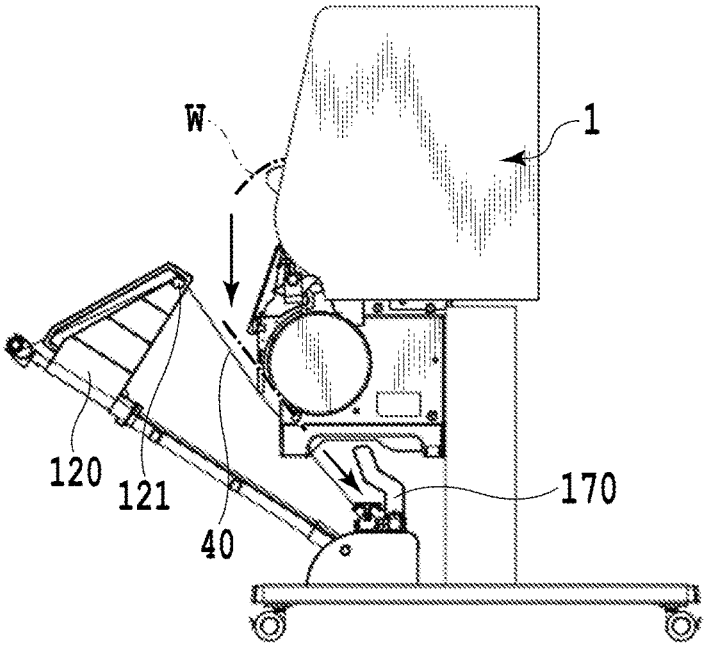
FIG. 22A is a side view.
Figure 22B:
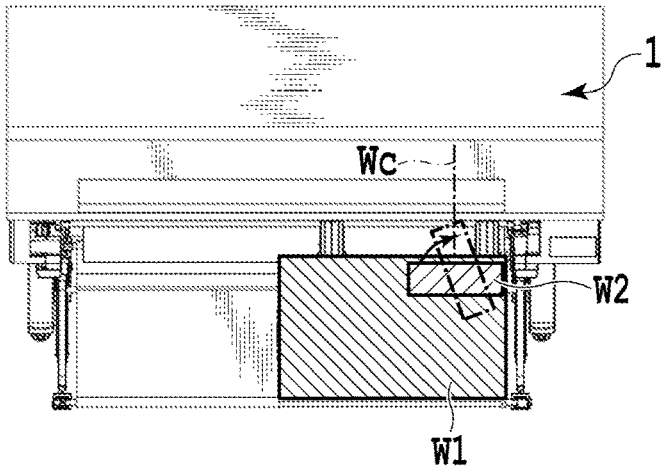
FIG. 22B is a top view.
Figure 22C:
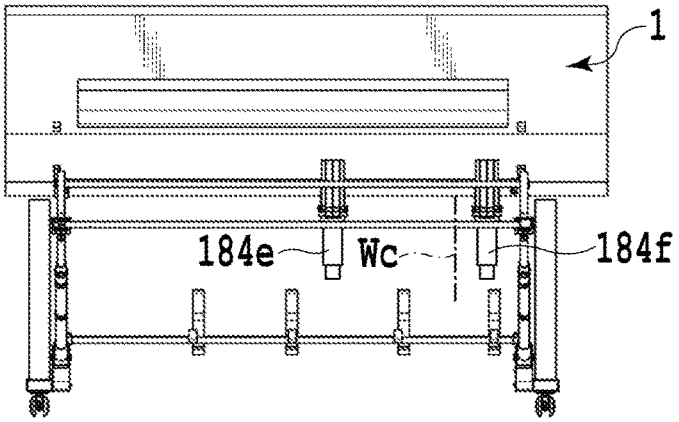
FIG. 22C is a front view of a printing apparatus according to a third example of the fifth reception embodiment.
Figure 23A:
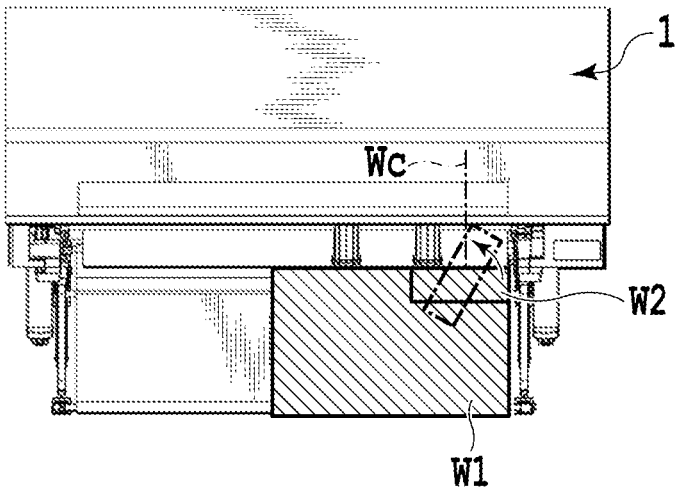
FIG. 23A is a top view and FIG. 23B is a front view of another printing apparatus according to the third example of the fifth reception embodiment.
Figure 23B:
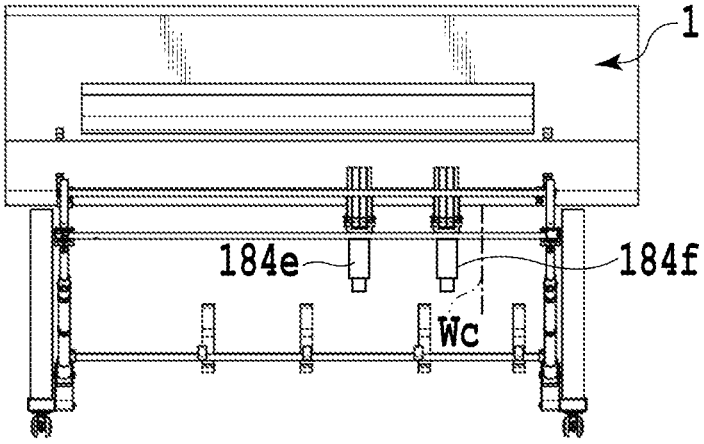

FIG. 22A is a side view, FIG. 22B is a top view, and FIG. 22C is a front view of a printing apparatus according to a third example of the fifth reception embodiment. Note that illustration of the receiver 40 is omitted in the front view of FIG. 22C in order to facilitate the understanding of the configuration of components behind the receiver 40. In the following, a description will be given of different features between the printing apparatus of this example and the printing apparatus according to the above-described first example of the fifth reception embodiment. As shown in FIGS. 22B and 22C, two guides 184*e* and 184*f* are provided to the printing apparatus of this example. The guide 184*e* is provided inside (the right side on the sheet surface of FIGS. 22B and 22C) of the width of a sheet W1 (such as A1 portrait or larger) which is larger than a predetermined width and outside (the left side on the sheet surface of FIGS. 22B and 22C) of the width of a sheet W2 (such as A2 portrait or smaller) which is smaller than the predetermined width. The guide 184*f* is provided on the right side of a central part Wc in the sheet width direction of the sheet W2 (such as A2 portrait or smaller) which is smaller than the predetermined width. A front end of the sheet W1 (such as A1 portrait or larger) which is larger than the predetermined width comes into contact with the two guides 184*e* and 184*f*. Then, as with the above-described first example of the fifth reception embodiment, the sheet bulges outward (to the side away from the body 1) by using the intermediate rod 121 as an inflection point. When the sheet is cut out, the sheet is reversed and stored with its printed surface laid face-down. On the other hand, the sheet W2 (such as A2 portrait or smaller) which is smaller than the predetermined width does not have the enough length for bulging out by using the intermediate rod 121 as the inflection point and does not come into contact with the guide 184*e* on the left side. For this reason, a front end of this sheet comes into contact only with the guide 184*f* on the right side. Here, the guide 184*f* is located on the right side of the central part Wc in the sheet width direction of the sheet. Accordingly, the sheet falls while rolling in one direction (clockwise in FIG. 22B) about a point of contact with the guide 184*f* as the center owing to its own weight, and is stored on the receiver 40 below the body 1. Here, as shown in FIGS. 23A and 23B, the guide 184*f* may be provided on the left side of the central part Wc in the sheet width direction of the sheet W2 which is smaller than the predetermined width. In this case, the sheet W2 coming into contact with the guide 184*f* falls while rolling in the other direction (counterclockwise in FIG. 23A) about the point of contact.

As described above, in the fifth reception embodiment, one or more guides 184 in which the flappers 183 and the sliding plates 186 are operable independently of one another are installed or moved depending on the widths of the sheets. In this way, the printing apparatus 10 can sort and store sheets in a greater variety of sizes as compared to the printing apparatus according to the Japanese Patent Laid-Open No. 2015-189522 in which the second reception members having the function equivalent to that of the flappers 183 are configured to interlock with one another.

Note that this example describes the case in which the guides 184*e* and 184*f* are configured to be attachable and detachable. When the guides 184*e* and 184*f* are configured to be movable instead, the user is allowed to move the guide 184*f* depending on the sizes of the sheets. Although the two guides 184*e* and 184*f* are provided in this example, the present invention is not limited only to this configuration. For instance, one guide 184 or three or more guides 184 may be provided as long as such a configuration can block passage of a large sheet and bring the sheet into contact with the guide and then reverse and store the sheet, while allowing a sheet that is smaller than the predetermined width.

Figure 24A:
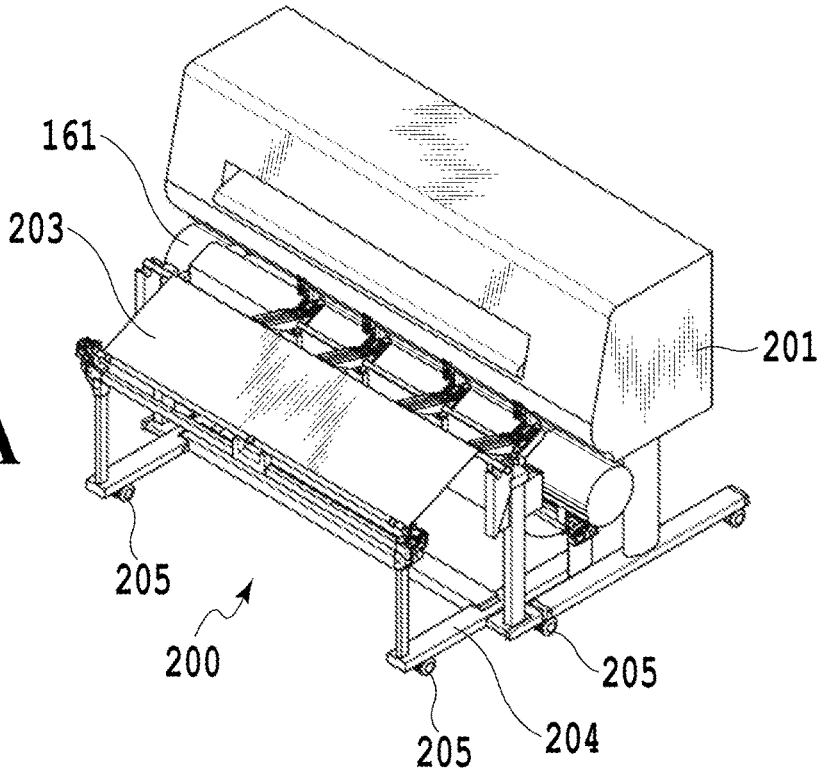
FIGS. 24A and 24B are perspective views of another printing apparatus according to the embodiment of the present invention.
Figure 24B:
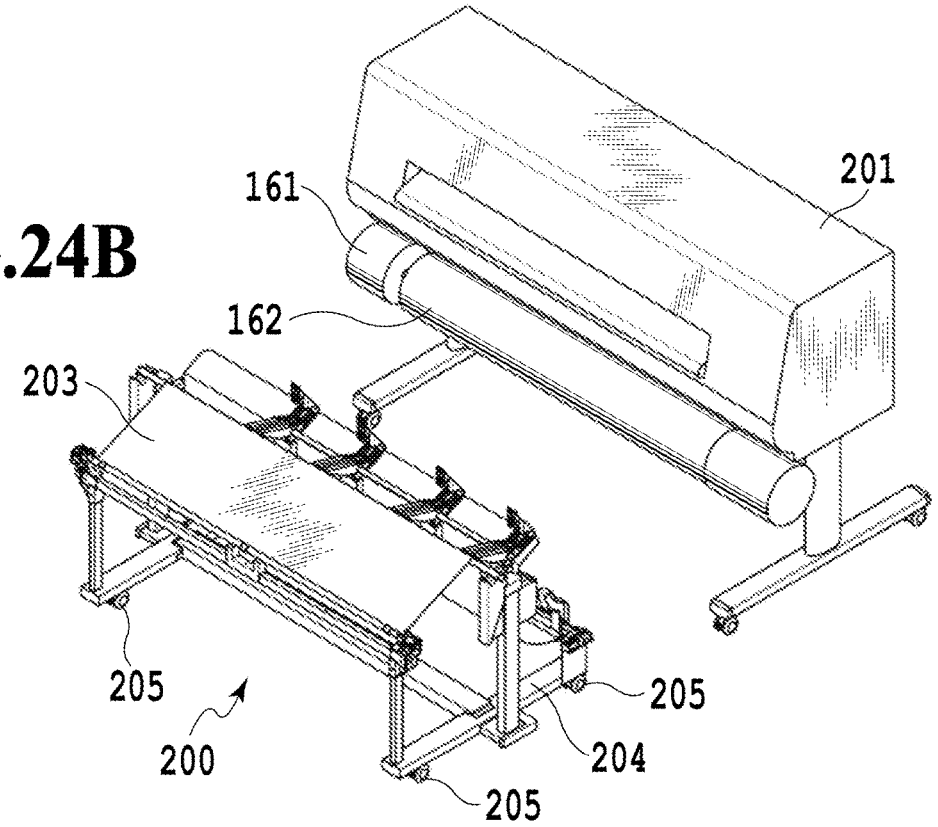

Each of the aforementioned examples has been described by using the printing apparatus integrated with the sheet storage apparatus. However, the present invention is not limited only to this configuration. For instance, as shown in FIGS. 24A and 24B, a printing apparatus 200 that can apply the present invention may replace the sheet basket 3 with a different sheet basket 203 that is attachable to and detachable from a body 201. In this printing apparatus 200, the mechanisms for storing and placing the sheets are the same as those of the above-described examples. The sheet basket 203 is held by a base unit 204 that is independent from the body 201. The base unit 204 may include wheels 205, so that the sheet basket 203 can be moved easily in this case. It is possible to separate the sheet basket 203 from the body 201 without removing the sheets stored therein. The operation to replace the rolls 162 set on the roll holders 160 and 161 is facilitated by separating the sheet basket 203 from the body 201.

The sheet basket 3 in the printing apparatus 10 may be configured to store sheets discharged not only from the printing apparatus but also from various sheet processing apparatuses such as an image scanning apparatus. The printing apparatus 10 may also use sheets other than sheets that are reeled out of the rolls. Moreover, although the flappers 183 are configured to be turnable, the present invention is not limited only to this configuration. Specifically, each flapper 183 only needs to have such a configuration that can be changed to a position where it is possible to support the front end portion of the sheet discharged from the discharge port 1*a* or to a position where the flapper 183 does not support the front end portion of the sheet. To be more precise, each flapper 183 may be made slidable between the position to support the front end portion of the sheet and the position not to support the front portion. At this time, each flapper 183 is operated independently and is movably provided to the corresponding guide 184.

As described above, according to the present invention, it is possible to provide a sheet storage apparatus that stores a discharged printed sheet, and to provide a printing apparatus including the sheet storage apparatus.

Moreover, according to an embodiment of the present invention, it is possible to provide a sheet storage apparatus which is capable of reliably storing a strongly curling sheet, and to provide a printing apparatus including the sheet storage apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-35277, filed Feb. 27, 2017 and No. 2017-95541, filed May 12, 2017, which are hereby incorporated by reference herein in their entirety.

What is claimed is:

1. A printing apparatus comprising:

a printing unit configured to perform printing on a sheet conveyed in a conveyance direction;

a discharge port configured to discharge the sheet on which printing has been performed by the printing unit;

a receiving unit configured to receive the sheet being discharged from the discharge port at a position below the discharge port; and a sheet butting unit provided on an upstream side of the receiving unit with respect to the conveyance direction and configured to regulate movement of a front end of the sheet, wherein the sheet butting unit has a first surface provided facing the receiving unit and on which a plurality of projections are arranged, and a second surface provided above the first surface and on which a plurality of projections are arranged.

2. The printing apparatus according to claim 1, wherein the first surface is arranged in a vertical direction.

3. The printing apparatus according to claim 2, wherein the plurality of the projections provided on the first surface are formed such that at least one of the projections located at a vertically upper part has a greater height.

4. The printing apparatus according to claim 1, wherein the second surface is arranged in a discharge direction of the sheet.

5. The printing apparatus according to claim 4, wherein the plurality of the projections provided on the second surface have heights such that the projection among the arranged projections which is located on the most downstream side with respect to the discharge direction of the sheet is formed to be higher than the rest of the projections.

6. The printing apparatus according to claim 1, wherein the height of the projections is greater than a value obtained by multiplying a maximum thickness of a sheet useable in the apparatus by a maximum number of the sheets useable in the apparatus.

* * * * *